US011332998B2

(12) United States Patent
Johnson et al.

(10) Patent No.: US 11,332,998 B2
(45) Date of Patent: May 17, 2022

(54) ANNULAR SEALING SYSTEM AND INTEGRATED MANAGED PRESSURE DRILLING RISER JOINT

(71) Applicant: AMERIFORGE GROUP INC., Houston, TX (US)

(72) Inventors: Austin Johnson, Houston, TX (US); Justin Fraczek, The Woodlands, TX (US); Robert H. J. Pinkstone, Chester (GB)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 17/233,082

(22) Filed: Apr. 16, 2021

(65) Prior Publication Data

US 2021/0230963 A1 Jul. 29, 2021

Related U.S. Application Data

(63) Continuation of application No. PCT/US2019/051234, filed on Sep. 16, 2019.

(Continued)

(51) Int. Cl.

| | |
|---|---|
| ***E21B 17/01*** | (2006.01) |
| ***E21B 23/06*** | (2006.01) |
| ***E21B 33/12*** | (2006.01) |

(52) U.S. Cl.

CPC ..... *E21B 33/1208* (2013.01); *E21B 17/01* (2013.01); *E21B 23/06* (2013.01)

(58) Field of Classification Search

CPC ..... E21B 33/1208; E21B 17/01; E21B 23/06

See application file for complete search history.

(56) References Cited

U.S. PATENT DOCUMENTS

| | | | |
|---|---|---|---|
| 3,561,723 | A | 2/1971 | Cugini |
| 3,955,822 | A | 5/1976 | Irby |

(Continued)

FOREIGN PATENT DOCUMENTS

| | | | |
|---|---|---|---|
| WO | 2019118394 | A1 | 6/2019 |
| WO | 2020081175 | A1 | 4/2020 |

(Continued)

OTHER PUBLICATIONS

International Search Report of the International Searching Authority (USPTO) for PCT International Application PCT/US2019/051234 dated Nov. 19, 2019.

(Continued)

*Primary Examiner* — Aaron L Lembo

(74) *Attorney, Agent, or Firm* — Basil M. Angelo; Angelo IP

(57) ABSTRACT

An integrated managed pressure drilling ("MPD") riser joint includes an annular sealing system that allows for the installation, engagement, service, maintenance, disengagement, removal, or replacement of one or more sealing elements while maintaining a pressure tight seal on the annulus without a drill string isolation tool, or equivalent thereof. The integrated MPD riser joint is limited to the annular sealing system and a flow spool, or equivalent thereof, disposed directly below the annular sealing system, without any intervening pressure containment devices or systems. Advantageously, the integrated MPD riser joint does not require a drill string isolation tool, or equivalent thereof, and may be substantially shorter in length and weigh substantially less than a conventional integrated MPD riser joint. The reduction in size and weight enables adoption of MPD technology in applications where conventional integrated MPD riser joints are not economically feasible or are otherwise precluded from use.

10 Claims, 36 Drawing Sheets

Related U.S. Application Data

(60) Provisional application No. 62/748,232, filed on Oct. 19, 2018.

(56) References Cited

U.S. PATENT DOCUMENTS

| | | | |
|---|---|---|---|
| 9,939,097 | B2 | 4/2018 | Pendleton |
| 10,024,310 | B2 | 7/2018 | Pendleton |
| 10,577,878 | B2 | 3/2020 | Johnson et al. |
| 10,590,721 | B2 | 3/2020 | Johnson et al. |
| 10,655,410 | B2 | 5/2020 | Johnson et al. |
| 10,995,573 | B2 | 5/2021 | Fraczek et al. |
| 11,008,825 | B2 | 5/2021 | Fraczek et al. |
| 2009/0152006 | A1 | 6/2009 | Leduc et al. |
| 2010/0175882 | A1 | 7/2010 | Bailey et al. |
| 2011/0024195 | A1 | 2/2011 | Hoyer et al. |
| 2011/0253445 | A1 | 10/2011 | Hannegan et al. |
| 2012/0217022 | A1 | 8/2012 | Michaud et al. |
| 2012/0272764 | A1 | 11/2012 | Pendleton |
| 2013/0105141 | A1 | 5/2013 | Bernard et al. |
| 2013/0168578 | A1 | 7/2013 | Leuchtenberg et al. |
| 2014/0231075 | A1 | 8/2014 | Springett et al. |
| 2014/0238686 | A1 | 8/2014 | Boyd |
| 2014/0311735 | A1 | 10/2014 | Landrith et al. |
| 2015/0144400 | A1 | 5/2015 | Leuchtenberg et al. |
| 2015/0376972 | A1 | 12/2015 | Lock |
| 2016/0010411 | A1 | 1/2016 | Al-Rabeh |
| 2016/0186515 | A1 | 6/2016 | Gilmore et al. |
| 2016/0186908 | A1 | 6/2016 | Pendleton |
| 2017/0009550 | A1 | 1/2017 | Leuchtenberg et al. |
| 2017/0044857 | A1 | 2/2017 | Leuchtenberg |
| 2017/0191333 | A1 | 7/2017 | Lewis et al. |
| 2018/0258730 | A1 | 9/2018 | Grace et al. |
| 2019/0055791 | A1 | 2/2019 | Barela |
| 2019/0120000 | A1 | 4/2019 | Santos |
| 2019/0145203 | A1 | 5/2019 | Johnson et al. |
| 2019/0145204 | A1 | 5/2019 | Johnson et al. |
| 2019/0145205 | A1 | 5/2019 | Johnson et al. |
| 2020/0300051 | A1 | 9/2020 | Johnson et al. |
| 2020/0300052 | A1 | 9/2020 | Johnson et al. |
| 2020/0362651 | A1 | 11/2020 | Fraczek et al. |
| 2020/0362659 | A1 | 11/2020 | Fraczek et al. |
| 2021/0207447 | A1 | 7/2021 | Fraczek et al. |
| 2021/0230963 | A1 | 7/2021 | Johnson et al. |
| 2021/0246754 | A1 | 8/2021 | Fraczek et al. |
| 2021/0246755 | A1 | 8/2021 | Johnson et al. |

FOREIGN PATENT DOCUMENTS

| | | | |
|---|---|---|---|
| WO | 2020091900 | A1 | 5/2020 |
| WO | PCTUS2020061178 | | 11/2020 |
| WO | WO2021150299 | | 11/2020 |

OTHER PUBLICATIONS

Written Opinion of the International Searching Authority (USPTO) for PCT International Application PCT/US2019/051234 dated Nov. 19, 2019.

U.S. Appl. No. 17/233,082, filed Apr. 16, 2021, Austin Johnson.

European Patent Office Extended European Search Report for EP 18888557.8 filed on May 28, 2020, dated Jun. 29, 2021.

Johnson, Austin, Fraczek, Justin, and Anderson, Bo, Enhancing Technology Development Process Through Purpose-Built Testing and Training Facilities, Paper presented at the IADC/SPE Asia Pacific Drilling Technology Conference held in Bangkok, Thailand, Aug. 27-29, 2018, published as IADC/SPE-191038-MS by the Society of Petroleum Engineers.

Johnson, Austin, Nichols, Jess, Ameen, Kareem, and Fraczek, Justin, Simulated Drilling Testing of an Active Wellbore Sealing System on a Full-Scale Test Rig, Paper presented at the SPE/IADC Drilling International Conference and Exhibition held in The Hague, The Netherlands, Mar. 5-7, 2019, published as SPE/IADC-194079-MS by the Society of Petroleum Engineers.

Johnson, Austin, Sundaramoorthy Saravanan, Piccolo, Brian, and Fraczek, Justin, Real Time Condition Monitoring of the Wellbore Seal through Hydraulic Fluid Analysis Using an Active Wellbore Sealing System during Manged Pressure Drilling, Paper presented at Offshore Technology Conference Asia held in Kuala Lumpur, Malaysia, Mar. 20-23, 2018, published as OTC-28436-MS by Offshore Technology Conference.

PCT International Search Report for PCT International Application PCT/US2018/064839, filed Dec. 11, 2018, dated Feb. 27, 2019.

PCT International Search Report of International Search Authority (USPTO) for PCT/US2020/061178, filed on Nov. 19, 2020, dated Feb. 9, 2021.

PCT International Search Report of the International Searching Authority (USPTO) for PCT International Application PCT/US2019/051245 dated Nov. 19, 2019.

PCT Written Opinion of International Search Authority (USPTO) for PCT/US2020/061178, filed on Nov. 19, 2020, dated Feb. 9, 2021.

PCT Written Opinion of the International Search Authority for PCT International Application PCT/US2018/064839, filed Dec. 11, 2018, dated Feb. 27, 2019.

PCT Written Opinion of the International Searching Authority (USPTO) for PCT International Application PCT/US2019/051245 dated Nov. 19, 2019.

USPTO non-final office action issued in U.S. Appl. No. 16/896,612, filed Jun. 9, 2020, dated Aug. 31, 2021.

USPTO non-final office action issued in U.S. Appl. No. 16/896,625, filed Jun. 9, 2020, dated Aug. 31, 2021.

Applicant reply to USPTO non-final office action issued in U.S. Appl. No. 16/896,612, filed Jun. 6, 2020, submitted to the USPTO dated Nov. 10, 2021.

Applicant reply to USPTO non-final office action issued in U.S. Appl. No. 16/896,625, filed Jun. 9, 2020, submitted to the USPTO dated Nov. 10, 2021.

USPTO non-final office action issued in U.S. Appl. No. 17/244,078, filed Apr. 29, 2021, dated Jan. 13, 2022.

ANNULAR SEALING SYSTEM AND INTEGRATED MANAGED PRESSURE DRILLING RISER JOINT

CROSS-REFERENCE TO RELATED APPLICATIONS

This application is a continuation of PCT International Application PCT/US2019/051234, filed on Sep. 16, 2019, which claims the benefit of, or priority to, U.S. Provisional Patent Application Ser. No. 62/748,232, filed on Oct. 19, 2018, both of which are hereby incorporated by reference in their entirety for all purposes.

BACKGROUND OF THE INVENTION

Conventional closed-loop hydraulic drilling systems, sometimes referred to in the industry as managed pressure drilling ("MPD") systems, include an annular sealing system, a drill string isolation tool, and a flow spool, or equivalents thereof, that actively manage wellbore pressure during drilling and other operations. The annular sealing system typically includes an active control device ("ACD"), a rotating control device ("RCD"), or other type of sealing element that seal the annulus surrounding the drill string or drill pipe such that the annulus is encapsulated and not atmospheric. While the type and kind of annular sealing system may vary based on an application or design, the annular sealing system is designed to maintain a pressure tight seal on the annulus while the drill string or drill pipe is rotated.

The drill string isolation tool is disposed directly below the annular sealing system and typically includes an additional sealing element that is used to encapsulate the well and maintain annular pressure while the annular sealing system, or components thereof, are being installed, serviced, removed, or otherwise disengaged. The flow spool is disposed directly below the drill string isolation tool and, as part of the pressurized fluid return system, diverts fluids from below the annular seal to the surface. The flow spool is in fluid communication with a choke manifold, typically disposed on a platform of the drilling rig, that is in fluid communication with a mud-gas separator or other fluids processing system disposed on a platform of the drilling rig. The pressure tight seal on the annulus allows for the precise control of wellbore pressure by manipulation of the choke settings of the choke manifold and the corresponding application of surface backpressure.

MPD systems find application in both onshore and offshore applications, including, but not limited to, underbalanced drilling ("UBD"), pressurized mud cap drilling ("PMCD"), floating mud cap drilling ("FMCD"), applied surface backpressure ("ASBP")-MPD, and other MPD drilling applications. However, MPD systems are increasingly becoming necessary, and in some cases, even required, in deepwater and ultra-deepwater applications. In these applications, the annular sealing system, drill string isolation tool, and flow spool are typically configured as part of an integrated MPD riser joint that is installed as part of the upper marine riser system. The integrated MPD riser joint may exceed 50 feet in length and weigh more than 100,000 pounds. In offshore applications, where deck space, weight-carrying capacity, and work space of the floating vessel are substantially constrained, the delivery, installation, and operation of the integrated MPD riser joint may not be feasible.

BRIEF SUMMARY OF THE INVENTION

According to one aspect of one or more embodiments of the present invention, a method of maintaining a pressure tight seal on an annulus surrounding drill pipe includes disposing a controllable upper sealing element and a controllable lower sealing element within an annular sealing system, receiving drill pipe through an inner diameter of the upper sealing element and the lower sealing element, controllably sealing the annulus with one or more of the upper sealing element and the lower sealing element, and maintaining the pressure tight seal on the annulus with the annular sealing system while installing, servicing, or removing one or more of the sealing elements of the annular sealing system.

According to one aspect of one or more embodiments of the present invention, an annular sealing system includes a controllable upper sealing element, and a controllable lower sealing element, wherein the upper sealing element and lower sealing element receive drill pipe through an inner diameter, and wherein an annulus surrounding the drill pipe is controllably sealed with one or more of the upper sealing element and the lower sealing element. The annular sealing system maintains a pressure tight seal on the annulus while installing, servicing, or removing one or more of the sealing elements of the annular sealing system.

According to one aspect of one or more embodiments of the present invention, an integrated managed pressure drilling riser joint for maintaining a pressure tight seal on an annulus surrounding drill pipe includes an annular sealing system having a controllable upper sealing element, and a controllable lower sealing element, wherein the upper sealing element and lower sealing element receive drill pipe through an inner diameter, and wherein an annulus surrounding the drill pipe is controllably sealed with one or more of the upper sealing element and the lower sealing element. The integrated managed pressure drilling riser joint includes a flow spool disposed directly below the annular sealing system to divert returning fluids to the surface. The annular sealing system maintains a pressure tight seal on the annulus while installing, servicing, or removing one or more of the sealing elements of the annular sealing system.

Other aspects of the present invention will be apparent from the following description and claims.

DETAILED DESCRIPTION OF THE INVENTION

Figure 1:
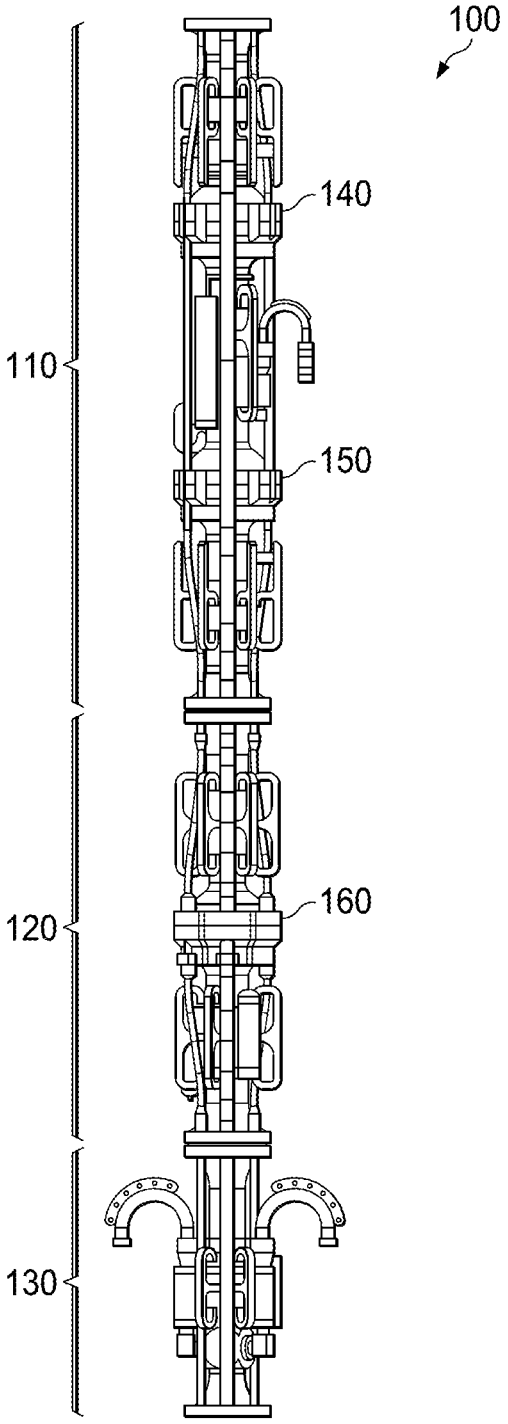
FIG. 1 PRIOR ART
FIG. 1 shows a conventional integrated MPD riser joint.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are purposefully not described to avoid obscuring the description of the present invention.

Despite the benefits provided by MPD technology, there is resistance to its adoption in certain deepwater and ultra-deepwater applications. In some situations, it is not economically feasible due to the cost, complexity, and logistics associated with the delivery and installation of the MPD system offshore. In other situations, it is not possible to deliver and install an MPD system offshore due to constraints on deck space, weight-carrying capacity, and work space of the floating vessel or the conditions of the environment in which it is intended to be used.

Accordingly, in one or more embodiments of the present invention, an integrated MPD riser joint is limited to an annular sealing system and a flow spool, or equivalent thereof, disposed directly below the annular sealing system. Advantageously, the integrated MPD riser joint does not require a drill string isolation tool, or equivalent thereof, and may be substantially shorter in length and weigh substantially less than a conventional integrated MPD riser joint. The reduction in size and weight enables adoption of MPD technology in applications where conventional integrated MPD riser joints are not economically feasible or are otherwise precluded from use. The annular sealing system allows for the installation, engagement, service, maintenance, disengagement, removal, or replacement of one or more sealing elements while maintaining a pressure tight seal on the annulus without a drill string isolation tool, or equivalent thereof. Advantageously, one or more sealing elements may be changed out during hole sections and in between bit runs. During bit runs, the subsea blow out preventer ("SSBOP") is typically closed allowing the marine riser to be depressurized, such that the annular sealing system may be disengaged, and the sealing elements freely replaced. Notwithstanding, the annular sealing system is capable of maintaining the pressure tight seal on the annulus during bit runs as well, if so desired.

FIG. 1 shows a conventional integrated MPD riser joint 100 configured for use as part of marine riser system (not shown). In offshore applications, a floating vessel (not shown), such as, for example, a semi-submersible, drillship, drill barge, or other floating rig or platform may be disposed over a body of water to facilitate drilling or other operations. A marine riser system (not independently illustrated) may provide fluid communication between the floating vessel (not shown) and a lower marine riser package ("LMRP") (not shown) or SSBOP (not shown) disposed on or near the ocean floor. The LMRP (not shown) or SSBOP are in fluid communication with the wellhead (not shown) of the wellbore (not shown). In below-tension-ring configurations (not shown) of an MPD system, a conventional integrated MPD riser joint 100 is disposed below the telescopic joint (not shown).

Conventional integrated MPD riser joint 100 includes an annular sealing system 110 disposed below a bottom distal end of the telescopic joint (not shown), a drill string isolation tool 120, or equivalent thereof, disposed directly below annular sealing system 110, and a flow spool 130, or equivalent thereof, disposed directly below drill string isolation tool 120. Annular sealing system 110 may be an ACD-type, RCD-type (not shown), or other type or kind of sealing system (not shown) that seals the annulus (not shown) surrounding the drill string or drill pipe (not shown) such that the annulus is encapsulated and not exposed to the atmosphere. In the ACD-type embodiment depicted, annular sealing system 110 includes an upper sealing element 140

(not shown, reference numeral depicting general location only) and a lower sealing element 150 (not shown, reference numeral depicting general location only) that seals the annulus surrounding the drill string or drill pipe (not shown). Upper sealing element 140 and lower sealing element 150 are typically attached to opposing ends of a mandrel, collectively referred to as a dual seal sleeve, and are engaged or disengaged at the same time. The redundant sealing mechanism extends the life of the sealing elements and increases the safety of operations.

Drill string isolation tool 120, or equivalent thereof, is disposed directly below annular sealing system 110 and provides an additional sealing element 160 (not shown, reference numeral depicting general location only) that encapsulates the well and seals the annulus surrounding the drill string or drill pipe when annular sealing system 110, or components thereof, are being installed, serviced, maintained, removed, or otherwise disengaged. For example, when sealing elements 140 and 150 require replacement while the marine riser is pressurized, such as, for example, during hole sections in between bit runs, drill string isolation tool 120 is engaged to maintain annular pressure while annular sealing system 110 is taken offline. To ensure the safety of operations, sealing element 160 seals the annulus surrounding the drill pipe (not shown) while the sealing elements 140 and 150 of annular sealing system 110 are removed and replaced. Flow spool 130, or equivalents thereof, is disposed directly below drill string isolation tool 120 and, as part of the pressurized fluid return system, diverts fluids (not shown) from below the annular seal to the surface (not shown). Flow spool 130 is in fluid communication with a choke manifold (not shown), typically disposed on a platform of the floating rig (not shown), that is in fluid communication with a mud-gas separator or other fluids processing system (not shown) disposed on the surface.

The pressure tight seal on the annulus provided by annular sealing system 110 allows for the precise control of wellbore pressure by manipulation of the choke settings of the choke manifold (not shown) and the corresponding application of surface backpressure. If the driller wishes to increase wellbore pressure, one or more chokes of the choke manifold (not shown) may be closed somewhat more than their last setting to further restrict fluid flow and apply additional surface backpressure. Similarly, if the driller wishes to decrease wellbore pressure, one or more chokes of the choke manifold (not shown) may be opened somewhat more than their last setting to increase fluid flow and reduce the amount of surface backpressure applied.

Figure 2A:
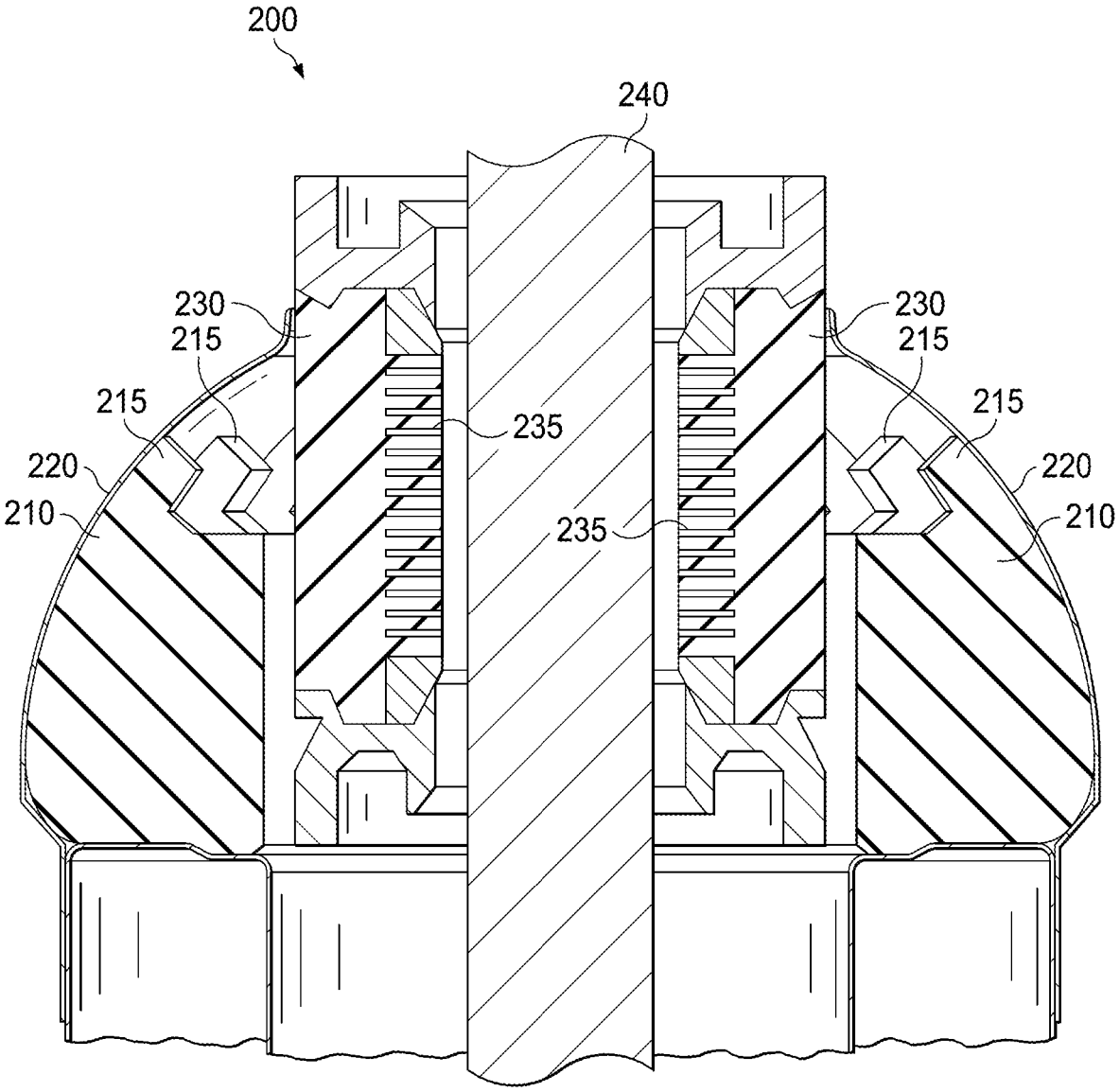
FIG. 2A PRIOR ART
FIG. 2A shows a cross-sectional view of an annular packer system of a conventional ACD-type annular sealing system in a disengaged state.
Figure 2B:
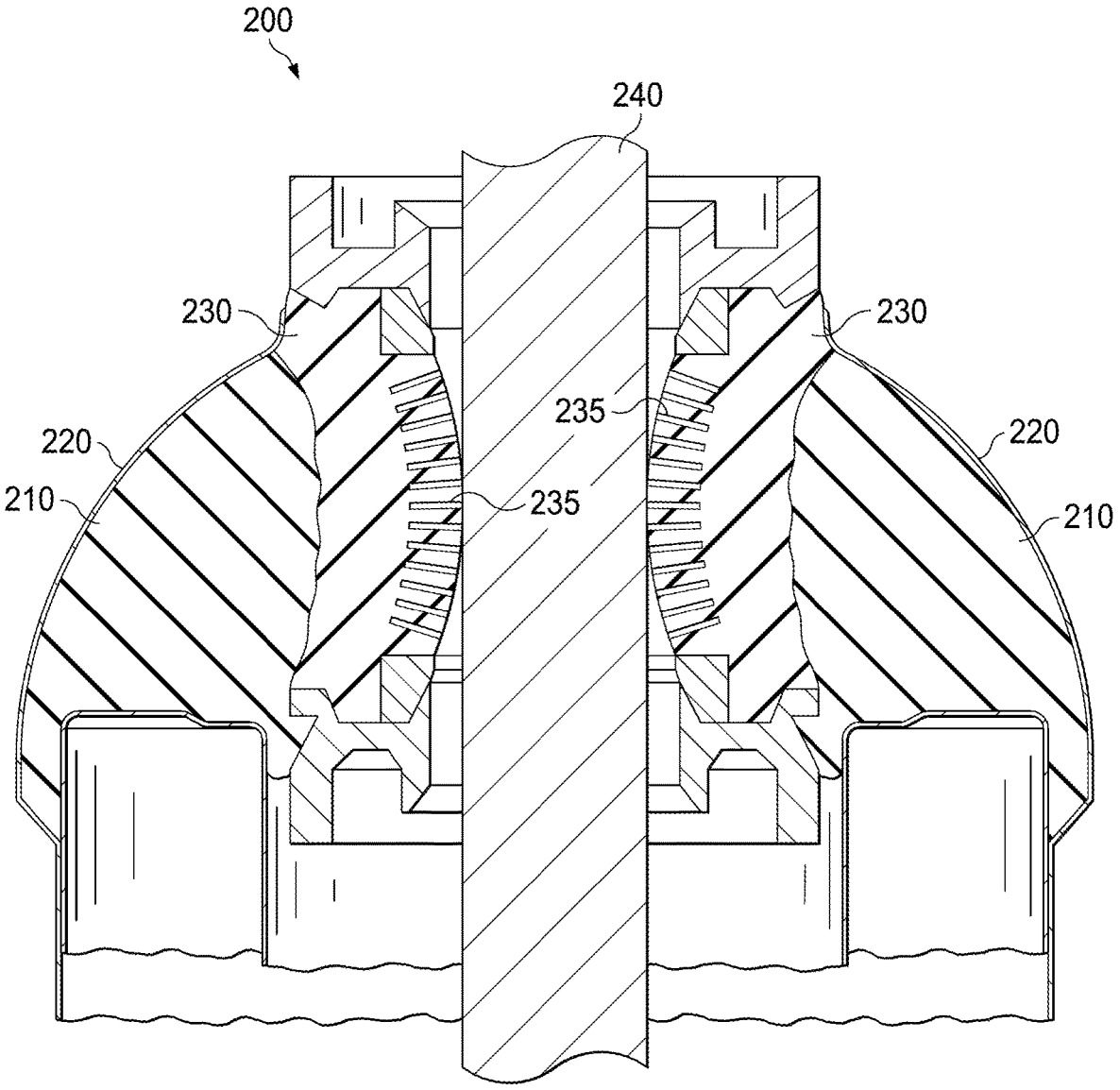
FIG. 2B PRIOR ART
FIG. 2B shows a cross-sectional view of the annular packer system of the conventional ACD-type annular sealing system in an engaged state.

FIG. 2A shows a cross-sectional view of an annular packer system 200 of a conventional ACD-type annular sealing system (e.g., 110 of FIG. 1) in a disengaged state. Annular packer system 200 includes a piston-actuated (not shown) annular packer 210 disposed within a radiused housing 220. Annular packer 210 comprises an elastomer or rubber body with a plurality of fingers or protrusions 215 that can travel within housing 220 when actuated. Sealing element 230 comprises a urethane matrix co-molded with a polytetrafluoroethylene ("PTFE") cage 235 that can receive drill pipe 240 therethrough. Sealing element 230 is disposed on a distal end of a mandrel (not shown) and another sealing element 230 (not shown) is disposed on the opposing distal end of the mandrel (not shown), typically referred to as a dual seal sleeve, for use in a conventional ACD-type annular sealing system (e.g., 110 of FIG. 1). Continuing, FIG. 2B shows a cross-sectional view of annular packer system 200 of the conventional ACD-type annular sealing system (e.g., 110 of FIG. 1) in an engaged state. When hydraulically actuated, a piston (not shown) causes the elastomer or rubber portion of packer 210 to travel within housing 220 such that fingers 215 come in contact with sealing element 230. When packer 210 is sufficiently actuated, sealing element 230 squeezes drill pipe 240 resulting in a pressure tight seal surrounding drill pipe 240. Sealing element 230 remains stationary while drill pipe 240 rotates. Conventional ACD-type annular sealing systems (e.g., 110 of FIG. 1) typically includes two annular packer systems 200 and the dual seal sleeve (not shown) disposed therein that provide the redundant seal previously discussed. The sealing elements 230 of the dual seal sleeve are engaged or disengaged at the same time and are installed, removed, or replaced at the same time.

While not shown, one of ordinary skill in the art will recognize that RCD-type annular sealing systems (not shown) typically include an upper sealing element (not shown) and a lower sealing element (not shown) that seal the annulus surrounding drill pipe 240, however, the dual sealing elements (not shown) rotate with drill pipe 240 while maintaining the pressure tight seal. Like ACD-type annular sealing systems (e.g., 110 of FIG. 1), the redundant sealing elements (not shown) of the RCD-type annular sealing system (not shown) are engaged or disengaged at the same time and are installed, removed, or replaced at the same time.

Figure 3A:
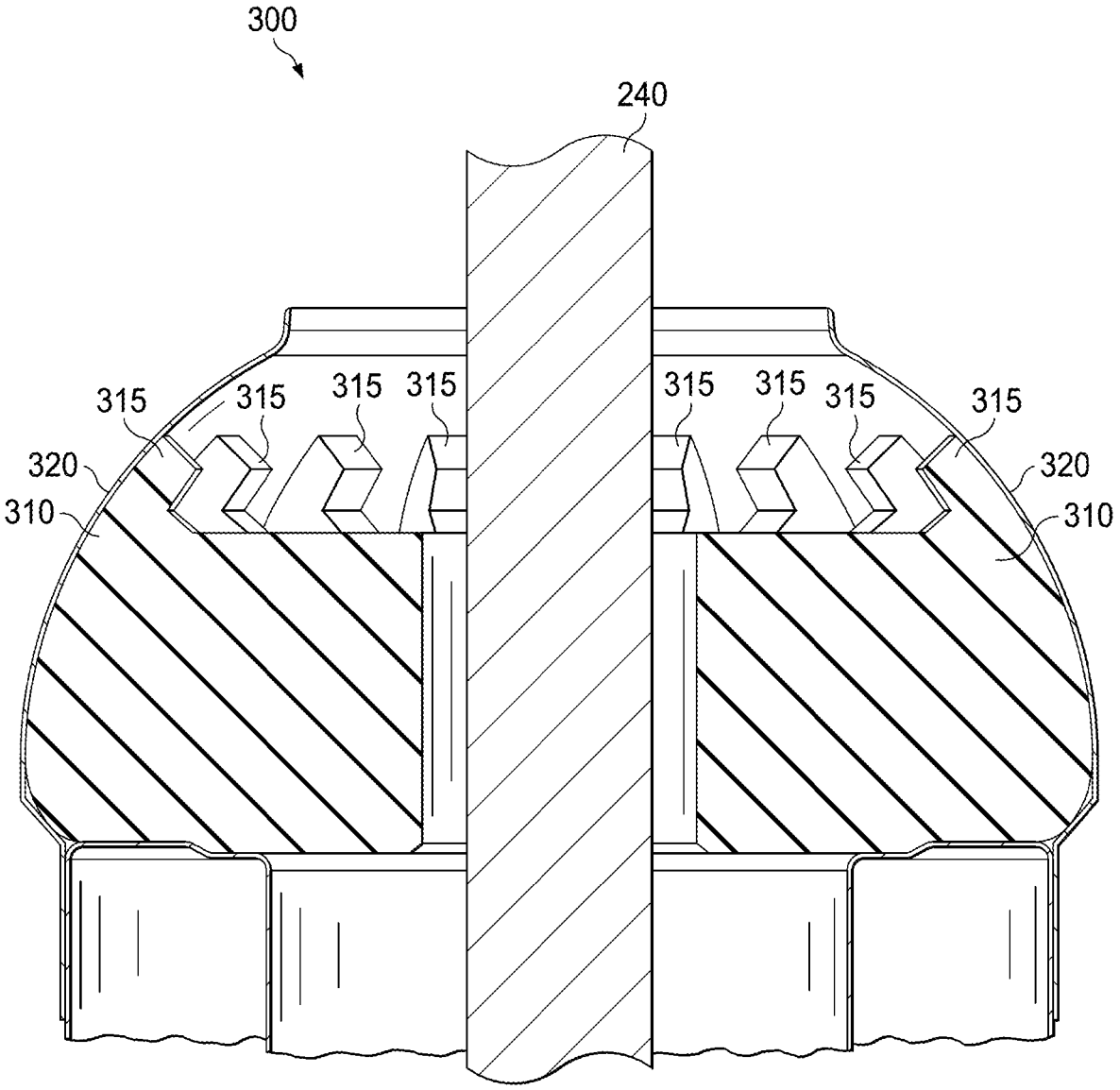
FIG. 3A PRIOR ART
FIG. 3A shows a cross-sectional view of an annular packer system of a drill string isolation tool in a disengaged state.
Figure 3B:
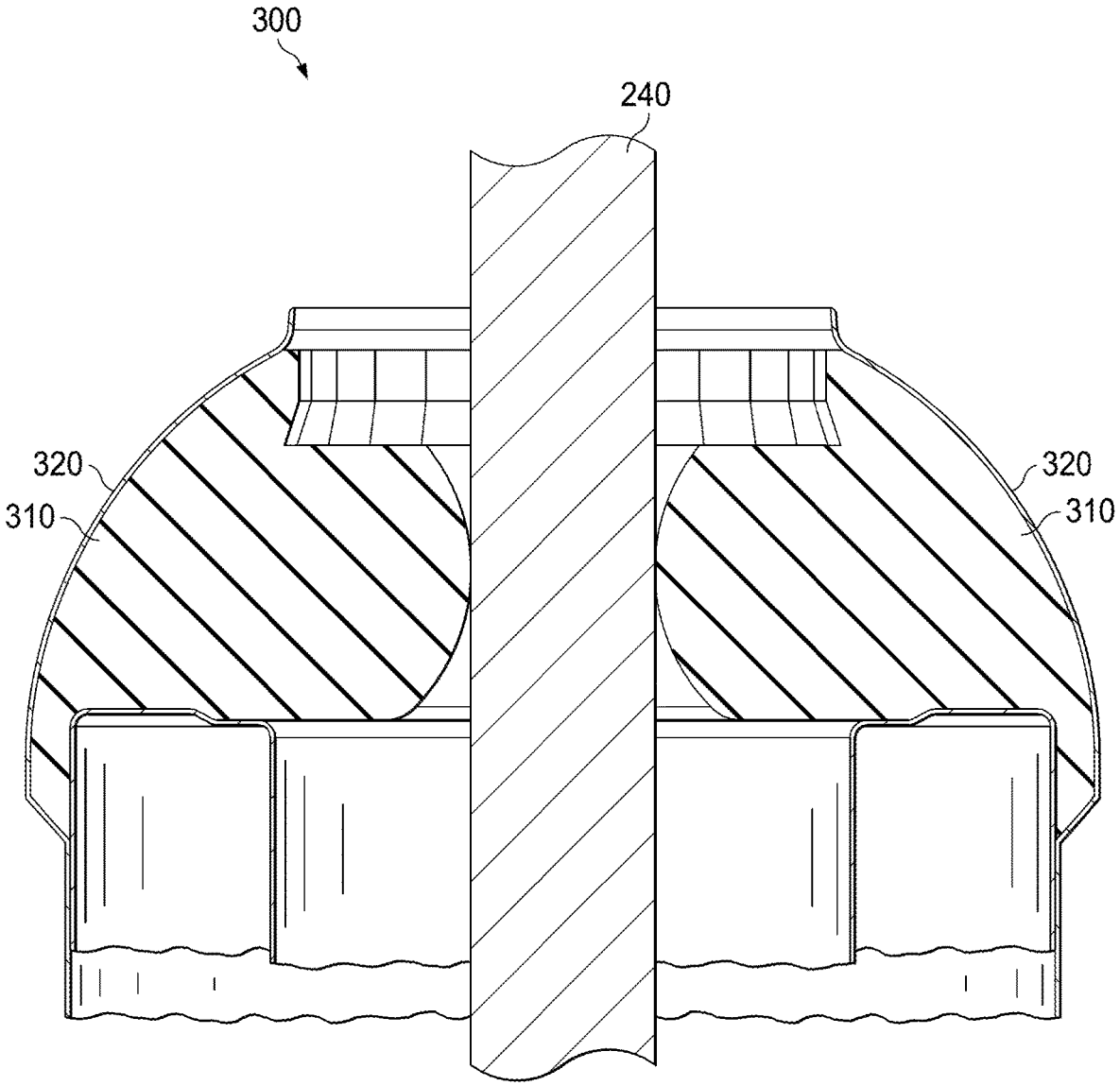
FIG. 3B PRIOR ART
FIG. 3B shows a cross-sectional view of the annular packer system of the drill string isolation tool in an engaged state.

FIG. 3A shows a cross-sectional view of an annular packer system 300 of a drill string isolation tool 120 in a disengaged state. Annular packer system 300 includes a piston-actuated (not shown) annular packer 310 disposed within a radiused housing 320. Annular packer 310 includes an elastomer or rubber body with a plurality of fingers or protrusions 315 that travel within housing 320 when actuated. In contrast to the annular packer system (e.g., 200 of FIG. 2) of the annular sealing system (e.g., 110 of FIG. 1), annular packer system 300 of drill string isolation tool 120 does not include a separate discrete sealing element (e.g., 230 of FIG. 2). Instead, annular packer 310 receives drill pipe 240 therethrough and annular packer 310 itself serves as the sealing element when sufficiently engaged, however, only for comparatively shorter periods of time. Continuing, FIG. 3B shows a cross-sectional view of annular packer system 300 of drill string isolation tool 120 in an engaged state. During conventional MPD drilling operations, the dual sealing elements (e.g., 230 of FIG. 2) of the annular sealing system (e.g., 110 of FIG. 1) seal the annulus surrounding drill pipe 240 as drill pipe 240 rotates and drill string isolation tool 120 is typically disengaged during such operations. However, when the annular sealing system (e.g., 110 of FIG. 1), or components thereof, require service or replacement in between bit runs, drill string isolation tool 120 is engaged to maintain annular pressure. When hydraulically actuated, a piston (not shown) causes the elastomer or rubber portion of packer 310 to travel within housing 320 such that fingers 315 come in contact with drill pipe 240. When packer 310 is sufficiently actuated, packer 310 squeezes drill pipe 240 resulting in a pressure tight seal surrounding drill pipe 240. Once the annular sealing system (e.g., 110 of FIG. 1) is brought back online, annular packer system 300 of drill string isolation tool 120 is once again disengaged.

In the disclosure that follows, one or more embodiments of the present invention are described relating to an integrated MPD riser joint consisting of an annular sealing system and a flow spool, or equivalent thereof, and specifically excludes a drill string isolation tool, or equivalent thereof. The annular sealing system maintains the pressure tight seal on the annulus while installing, servicing, or removing one or more of the sealing elements of the annular sealing system without any intervening pressure containment device or system.

In one or more embodiments of the present invention, a method of maintaining a pressure tight seal on an annulus surrounding drill pipe may include disposing an independently controllable upper sealing element and an independently controllable lower sealing element within an annular sealing system, receiving drill pipe through an inner diameter of the upper sealing element and the lower sealing element, controllably sealing the annulus with one or more of the upper sealing element and the lower sealing element, and maintaining a pressure tight seal on the annulus with the annular sealing system while installing, servicing, or removing one or more sealing elements of the annular sealing system. In certain embodiments, one or more of the sealing elements of the annular sealing system may maintain the pressure tight seal on the annulus. In other embodiments, one or more annular packers of the annular sealing system may maintain the pressure tight seal on the annulus. In still other embodiments, a combination of one or more sealing elements and one or more annular packers of the annular sealing system may maintain the pressure tight seal on the annulus.

In one or more embodiments of the present invention, an integrated MPD riser joint may include an annular sealing system having an independently controllable upper sealing element and an independently controllable lower sealing element. The upper sealing element and the lower sealing element may receive drill pipe through their inner diameter and the annulus surrounding the drill pipe may be controllably sealed with one or more of the upper sealing element and the lower sealing element. In certain embodiments, the annular sealing system may be an ACD-type annular sealing system. In other embodiments, the annular sealing system may be an RCD-type annular sealing system. In still other embodiments, the annular sealing system be a hybrid or any other type or kind of annular sealing system. A flow spool, or equivalent thereof, may be disposed directly below the annular sealing system, without any intervening pressure containment device or system, and may divert returning fluids to the surface. The annular sealing system may maintain the pressure tight seal on the annulus while installing, servicing, or removing one or more of the sealing elements and without any other pressure containment device or system. In certain embodiments, one or more of the sealing elements of the annular sealing system may maintain the pressure tight seal on the annulus. In other embodiments, one or more annular packers of the annular sealing system may maintain the pressure tight seal on the annulus. In still other embodiments, a combination of one or more sealing elements and one or more annular packers of the annular sealing system may maintain the pressure tight seal on the annulus.

In certain embodiments, the upper sealing element and the lower sealing element may be discrete components independently controllable and moveable. In such embodiments, one sealing element may be installed, engaged, serviced, disengaged, or removed while the other sealing element or an annular packer of the annular sealing system maintains the pressure tight seal on the annulus. In other embodiments, the upper sealing element and the lower sealing element may be attached to opposing ends of a spring-biased mandrel, the sealing elements may be independently controllable, and the sealing element disposed on the spring-biased end of the mandrel may be independently moveable from the other sealing element. In such embodiments, one sealing element may be installed, engaged, serviced, disengaged, or removed while the other sealing element or an annular packer of the annular sealing system maintains the pressure tight seal on the annulus. In still other embodiments, the upper sealing element and the lower sealing element may be attached to opposing ends of a spacer mandrel and the sealing elements may be independently controllable. A dual seal sleeve may include the upper sealing element, the spacer mandrel, and a lower sealing element. In such embodiments, one or more sealing elements or one or more annular packers may maintain the pressure tight seal on the annulus.

One of ordinary skill in the art will recognize that the above-noted embodiments are merely exemplary and other configurations that provide for the independent control of the sealing elements of the annular sealing system and, in some embodiments, one or more annular packer systems, that are capable of maintaining annular pressure while one or more of the sealing elements are being installed, engaged, serviced, disengaged, or removed, without the use of a drill string isolation tool, or equivalent thereof, is within the scope of one or more embodiments of the present invention.

Advantageously, the annular sealing system may be disposed directly above a flow spool, or equivalent thereof, without any intervening pressure containment device or system required as part of the integrated MPD riser joint. Because the integrated MPD riser joint may be limited to just the annular sealing system and the flow spool, or the equivalent thereof, the height and weight of the integrated MPD riser joint may be substantially reduced and logistic feasibility of delivery and installation may be substantially improved.

Figure 4A:
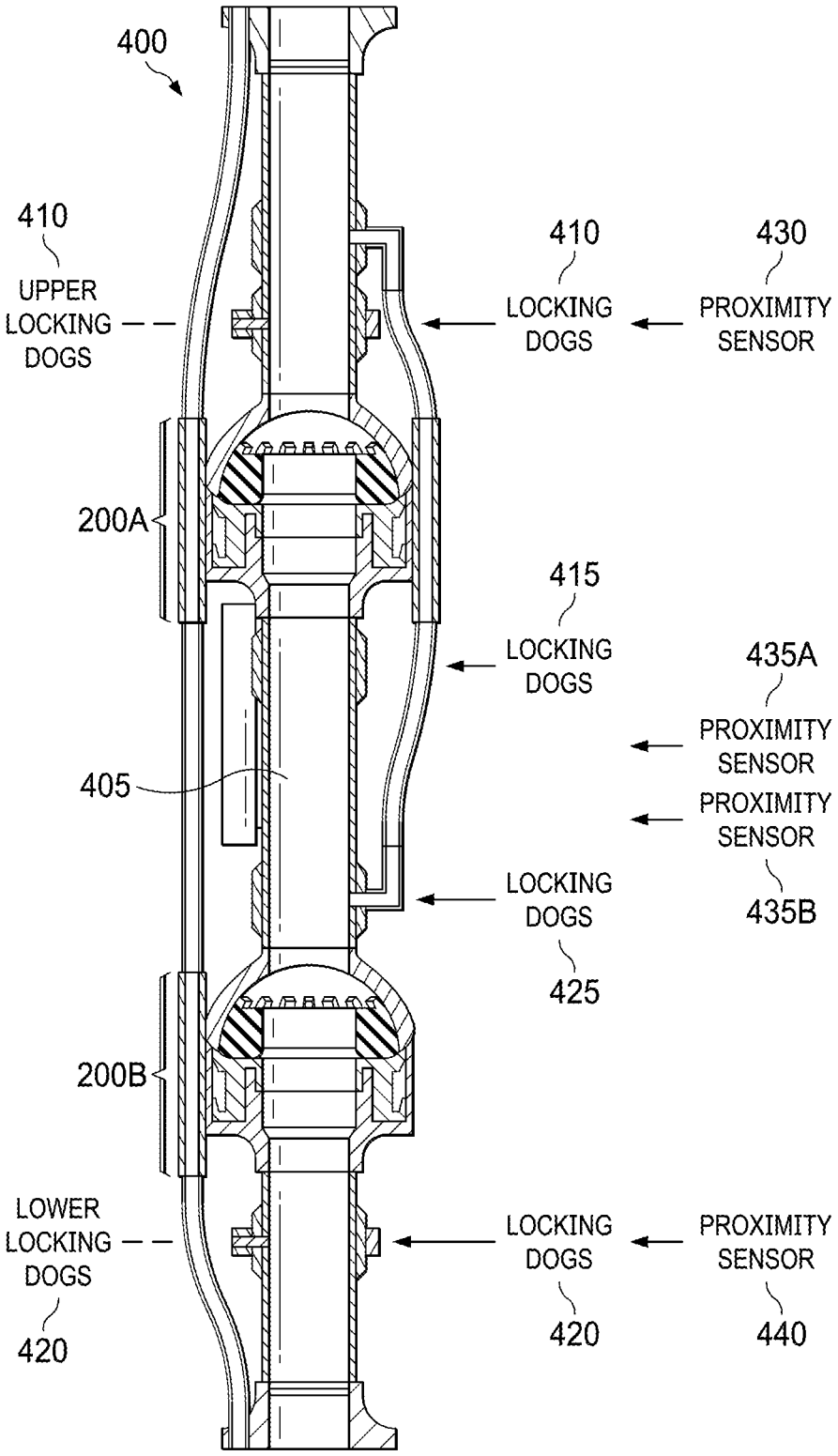
FIG. 4A shows a cross-sectional view of an ACD-type annular sealing system in accordance with one or more embodiments of the present invention.

FIG. 4A shows a cross-sectional view of an ACD-type annular sealing system 400 in accordance with one or more embodiments of the present invention. Annular sealing system 400 includes an upper annular packer system 200*a*, a lower annular packer system 200*b*, and an intermediate area 405 disposed in between. In a conventional ACD-type annular sealing system (e.g., 110 of FIG. 1), a plurality of locking dogs 410 (not shown, reference numeral depicting general location only) are disposed above the top side of upper annular packer system 200*a* and a plurality of locking dogs 420 (not shown, reference numeral depicting general location only) are disposed below the bottom side of lower annular packer system 200*b*, that are operatively used to secure the conventional seal sleeve (e.g., dual sealing elements 230 of FIG. 2 disposed on opposing ends of a mandrel) in place. Typically, the plurality of locking dogs 420 (not shown, reference numeral depicting general location only) disposed below the bottom side of lower annular packer system 200*b* are only unlocked when a bit run is made.

In contrast, annular sealing system 400 may include one or more pluralities of locking dogs 410 (not shown, reference numeral depicting general location only) disposed above the top side of upper annular packer 200*a* and one or more pluralities of locking dogs 415 (not shown, reference numeral depicting general location only) disposed below the bottom side of upper annular packer 200*a* that span the area where an independently controllable upper sealing element (not shown) may be operatively disposed and one or more pluralities of locking dogs 425 (not shown, reference numeral depicting general location only) disposed above the top side of lower annular packer system 200*b* and one or more pluralities of locking dogs 420 (not shown, reference numeral depicting general location only) disposed below the bottom side of lower annular packer system 200*b* that span the area where an independently controllable lower sealing element (not shown) may be operatively disposed.

To assist in guiding the retrieval and deployment of sealing elements (not shown), one or more proximity sensors may be disposed in annular sealing system 400. In certain embodiments, annular sealing system 400 may include one or more proximity sensors 430 (not shown, reference numeral depicting general location only) disposed above the top side of upper annular packer system 200*a* and one or more proximity sensors 435*a* (not shown, reference numeral depicting general location only) disposed below the bottom side of upper annular packer system 200*a* that bookend the area where the upper sealing element (not shown) may be operatively disposed and one or more proximity sensors 435*b* (not shown, reference numeral depicting general location only) disposed above the top side of lower annular packer system 200*b* and one or more proximity sensors 440 (not shown, reference numeral depicting general location only) disposed below the bottom side of lower annular packer system 200*b* that bookend the area where the lower sealing element (not shown) may be operatively disposed. The proximity sensors may be of any type or kind suitable for detecting the proximate location of the sealing elements (not shown) within annular sealing system 400. One of ordinary skill in the art will recognize that the type or kind, number, and location of proximity sensors disposed within annular sealing system 400 may vary based on application or design in accordance with one or more embodiments of the present invention.

During operations involving running one or more sealing elements (not shown) in or out, the risk of dropping a sealing element (not shown) onto one or more of the pluralities of locking dogs (e.g., 415, 420, and 425) may be mitigated by monitoring one or more proximity sensors (e.g., 430, 435, 440). In addition, the risk of dropping a sealing element (not shown) downhole is eliminated by the pluralities of locking dogs (e.g., 415, 420, and 425) extended in the locked state and an optional no-go shoulder (not shown) disposed within annular sealing system 400 below lower annular packer system 200*b*. The no-go-shoulder (not shown) may prevent a sealing element (not shown) from falling through and escaping annular sealing system 400.

One of ordinary skill in the art will recognize that an RCD-type annular sealing system (not shown) may include a similar plurality of locking dogs (not shown) and proximity sensors (not shown) to secure and detect seal and bearing assemblies (not shown) in a similar manner as described herein with respect to an ACD-type annular system 400 in accordance with one or more embodiments of the present invention.

Figure 4B:
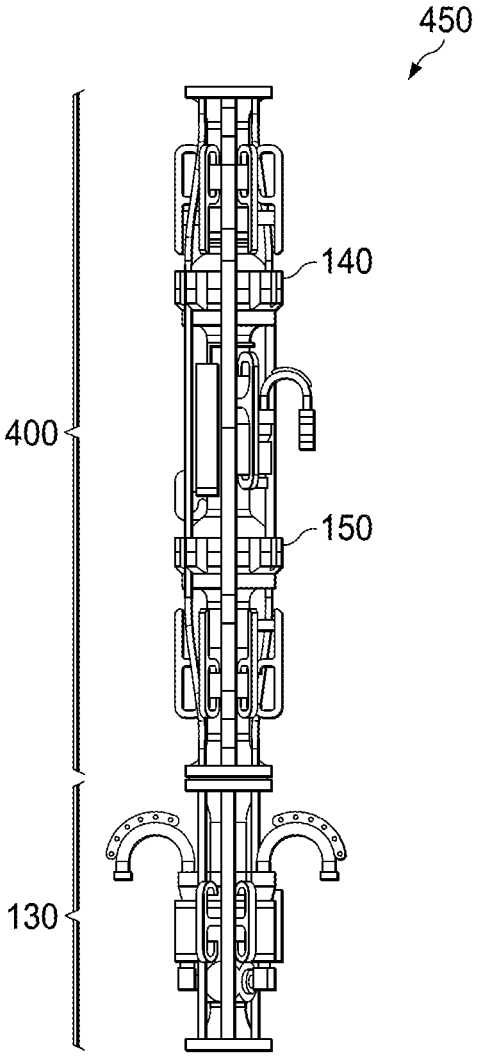
FIG. 4B shows a cross-sectional view of an integrated MPD riser joint in accordance with one or more embodiments of the present invention.

FIG. 4B shows an integrated MPD riser joint 450 in accordance with one or more embodiments of the present invention. An integrated MPD riser joint 450 may include an annular sealing system 400 and a flow spool 130, or equivalent thereof, disposed directly below the annular sealing system 400. The annular sealing system 400 may include an independently controllable upper sealing element (not shown) and an independently controllable lower sealing element (not shown) where the upper sealing element (not shown) and the lower sealing element (not shown) may receive drill pipe (not shown) through an inner diameter and the annulus surrounding the drill pipe (not shown) may be controllably sealed with one or more of the upper sealing element (not shown) and the lower sealing element (not shown) during normal operations. The annular sealing system 400 may maintain the pressure tight seal on the annulus while installing, engaging, servicing, disengaging, or removing one or more of the sealing elements (not shown) as discussed in more detail herein.

Figure 5A:
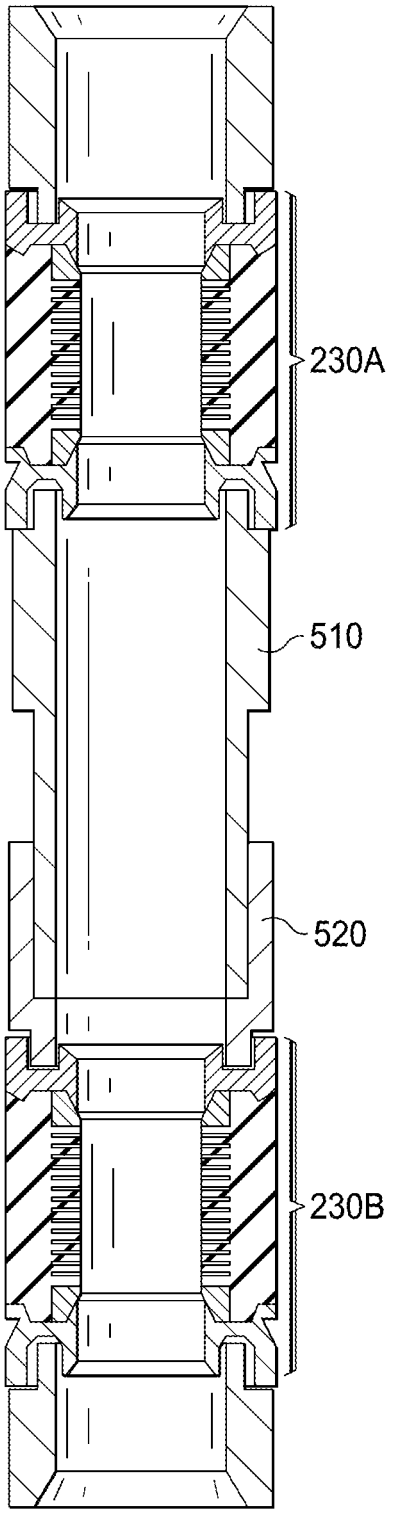
FIG. 5A shows a cross-sectional view of an upper sealing element and a lower sealing element of an ACD-type annular sealing system disposed on spacer mandrels in accordance with one or more embodiments of the present invention.

FIG. 5A shows a cross-sectional view of an upper sealing element 230*a* and a lower sealing element 230*b* of an ACD-type annular sealing system (e.g., 400 of FIG. 4) disposed on spacer mandrels 510, 520 in accordance with one or more embodiments of the present invention. In certain embodiments, upper sealing element 230*a* and lower sealing element 230*b* may be composed of a urethane matrix co-molded with a PTFE cage. One of ordinary skill in the art will recognize that other materials and compositions of material may be used in accordance with one or more embodiments of the present invention. Upper sealing element 230*a* may be attached to a first distal end of a first spacer mandrel 510 and lower sealing element 230*b* may be attached to a first distal end of a second spacer mandrel 520. A second distal end of first spacer mandrel 510 may removably come to rest within a shoulder portion of a second distal end of second spacer mandrel 520. Spacers 510 and 520 may provide spacing for deployment and retrieval purposes and space for engagement of one or more pluralities of locking dogs (not shown) may secure the sealing elements 230*a* and 230*b* in place within the annular sealing system (e.g., 400 of FIG. 4).

Each sealing element 230*a*, 230*b* may be substantially cylindrical in shape and have an inner diameter may receive drill pipe (not shown) therethrough with a close fit. During drilling operations, one or more of upper sealing element 230*a* and lower sealing element 230*b* may be engaged to provide an interference fit that seals the annulus (not shown) surrounding the drill pipe (not shown). Conventional ACD-type annular sealing systems (not shown) use a dual seal sleeve configuration including two sealing elements (not shown) disposed on opposing ends of a single mandrel (not shown) that are engaged at the same time to provide redundant sealing and increase the safety of operations. In contrast, in one or more embodiments of the present invention, upper sealing element 230*a* and lower sealing element 230*b* may be independently engaged or disengaged and independently moved in between bit runs while the annular sealing system (e.g., 400 of FIG. 4) maintains the pressure tight seal on the annulus (not shown). Advantageously, in such embodiments, upper sealing element 230*a* or upper sealing element 230*a* and lower sealing element 230*b* may be retrieved or deployed with a single run of a running tool while maintaining annular pressure as described herein.

In operation, an independently controllable upper sealing element 230*a* may be disposed on a first spacer mandrel 510 and an independently controllable lower sealing element 230*b* may be disposed on a second spacer mandrel 520 within the annular sealing system (e.g., 400 of FIG. 4). Upper sealing element 230*a* may be positioned for engagement by upper annular packer system 200*a* and lower sealing element 230*b* may be positioned for engagement by lower annular packer system 200*b*. Drill pipe (not shown) may be disposed through an inner diameter of the annular sealing system (e.g., 400 of FIG. 4). The annular sealing system (e.g., 400 of FIG. 4) may be engaged and the marine riser may be pressurized by engaging one or more of upper sealing element 230*a* and lower sealing element 230*b* by upper annular packer 200*a* and lower annular packer 200*b* respectively.

In typical applications, upper sealing element 230*a* and lower sealing element 230*b* are engaged at the same time to provide a redundant seal. For reasons beyond the scope of this disclosure, one of sealing elements 230*a* or 230*b* may wear at a faster rate than the other (typically, the upper sealing element 230*a*). If one of sealing elements 230*a* or 230*b* wears out in between bit runs, the worn sealing element 230*a* or 230*b* must be replaced, causing a premature end to drilling activities, substantial non-productive downtime, and requiring the time-consuming, complex, and costly task of depressurizing the marine riser (not shown). As such, it is highly desirable to be able to replace the worn sealing element 230*a* and/or 230*b* without depressurizing the marine riser (not shown), thereby minimizing non-productive downtime and safely maintaining marine riser (not shown) pressure. In one or more embodiments of the present invention, when a decision has been taken to replace a worn sealing element 230*a* or 230*b*, a stand of drill pipe (not shown) may be stripped out of upper sealing element 230*a* and lower sealing element 230*b*.

Figure 5B:
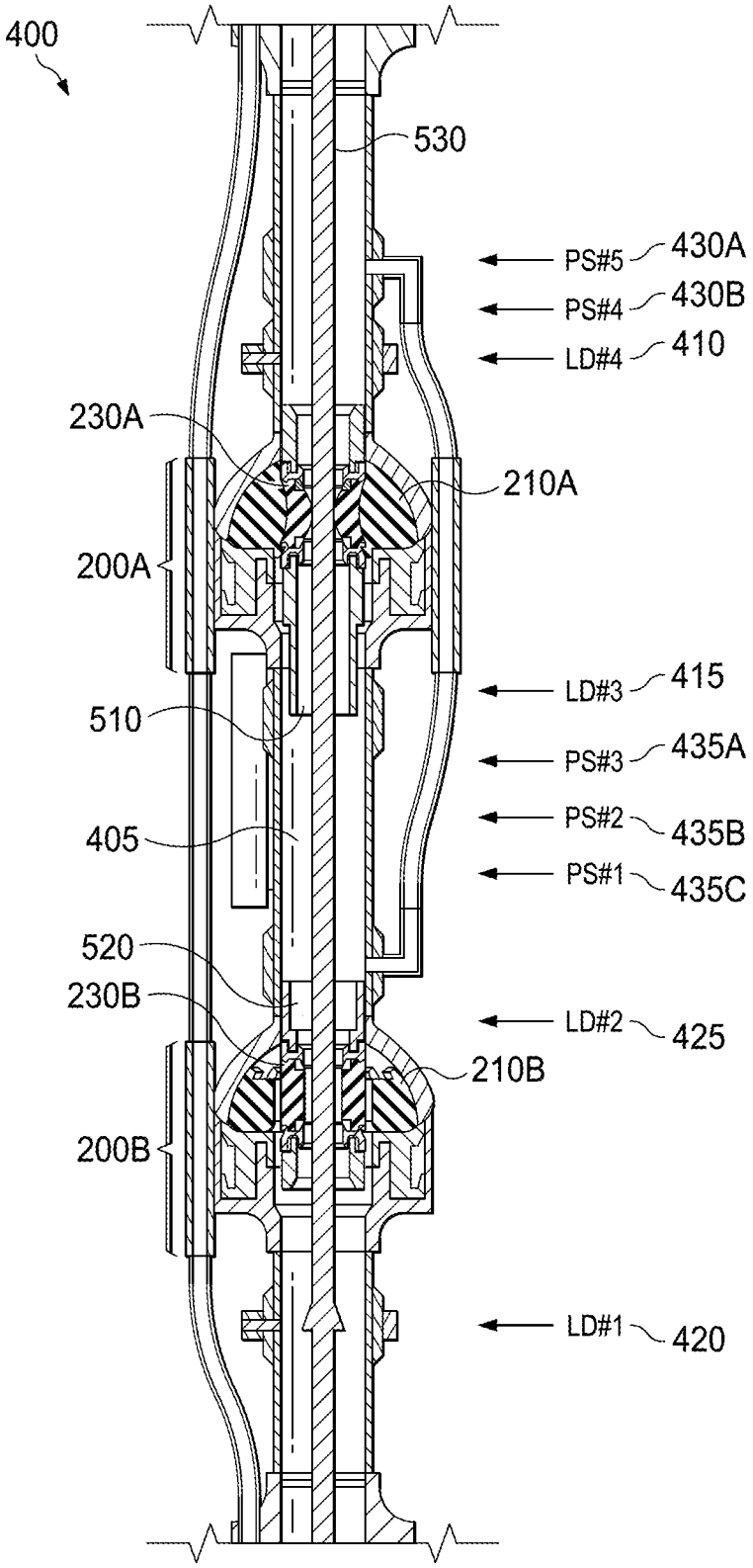
FIG. 5B shows a cross-sectional view of a running tool stripping in the annular sealing system, the upper sealing element, and the lower sealing element while the upper sealing element seals the annulus surrounding the running tool and a lower packer system of the annular sealing system is disengaged in accordance with one or more embodiments of the present invention.

Continuing, FIG. 5B shows a cross-sectional view of running tool 530 stripping in upper sealing element 230*a* and lower sealing element 230*b* of annular sealing 400, upper sealing element 230*a* seals the annulus surrounding running tool 530, and lower packer system 200*b* of annular sealing system 400 is disengaged in accordance with one or more embodiments of the present invention. Specifically, upper packer system 200*a* may be engaged to seal the annulus surrounding running tool 530 with upper sealing element 230*a*. When upper packer system 200*a* is engaged, upper annular packer 210*a* squeezes upper sealing element 230*a*. Lower packer system 200*b* may be disengaged to unseal the annulus surrounding running tool 530 with lower sealing element 230*b*. When lower packer system 200*b* is disengaged, lower annular packer 210*b* releases lower sealing element 230*b*. A plurality of locking dogs 425 (not shown, reference numeral depicting general location only) disposed above the top side of lower annular packer system 200*b* may then be unlocked.

Figure 5C:
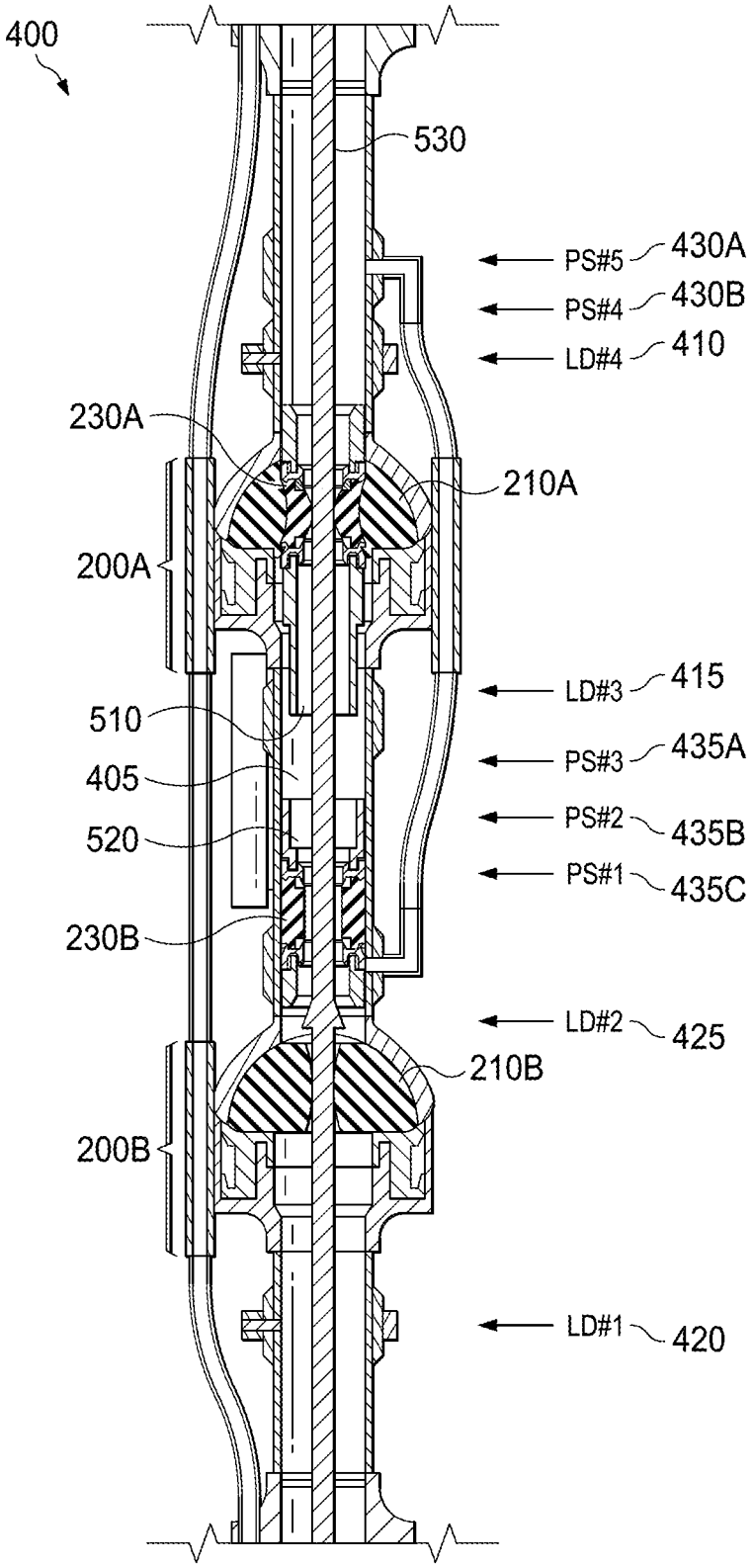
FIG. 5C shows a cross-sectional view of the running tool pulling the lower sealing element into an intermediate area of the annular sealing system while the upper sealing element seals the annulus surrounding the running tool in accordance with one or more embodiments of the present invention.

Continuing, FIG. 5C shows a cross-sectional view of running tool 530 pulling lower sealing element 230*b* into an intermediate area 405 of annular sealing system 400 while upper sealing element 230*a* seals the annulus surrounding running tool 530 in accordance with one or more embodiments of the present invention. With locking dogs 425 unlocked, lower sealing element 230*b* may be pulled into intermediate area 405 within annular sealing system 400 between a plurality of locking dogs 415 (not shown, reference numeral depicting general location only) disposed below the bottom side of upper annular packer system 200*a* and the plurality of locking dogs 425 (not shown, reference numeral depicting general location only) disposed above the top side of lower annular packer system 200*b*. The plurality of locking dogs 425 (not shown, reference numeral depicting general location only) disposed above the top side of the lower annular packer system 200*b* may be locked after a proximity sensor 435*c* (not shown, reference numeral depicting general location only) detects true that lower sealing element 230*b* has cleared lower annular packer system 200*b*. Lower annular packer system 200*b* may be engaged to seal the annulus surrounding running tool 530 with lower annular packer 210*b*. Then the pressure between intermediate area 405 and the marine riser annulus (not shown) above it may be equalized.

Figure 5D:
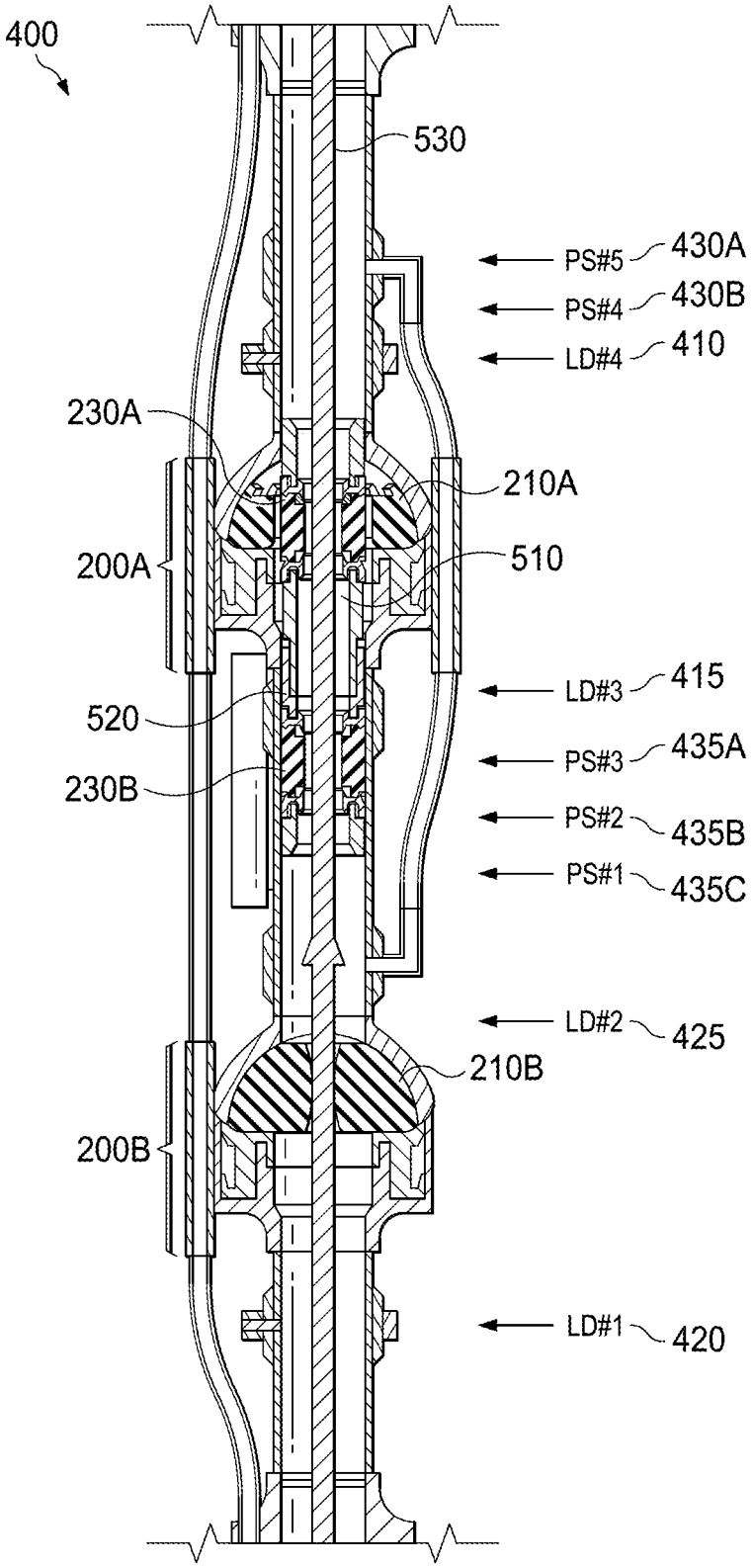
FIG. 5D shows a cross-sectional view of the running tool pulling the upper sealing element and the lower sealing element out in accordance with one or more embodiments of the present invention.

Continuing, FIG. 5D shows a cross-sectional view of running tool 530 prior to pulling upper sealing element 230*a* and lower sealing element 230*b* out in accordance with one or more embodiments of the present invention. Once the pressure is equalized, upper annular packer system 200*a* may be disengaged to unseal the annulus surrounding running tool 530 with upper sealing element 230*a*. A plurality of locking dogs 410 (not shown, reference numeral depicting general location only) disposed above the top side of upper annular packer system 200*a* may be unlocked. Running tool 530 may be stripped out slowly until upper sealing element 230*a* clears upper annular packer system 200*a*, as indicated by, for example, proximity sensor 430*b* (not shown, reference numeral depicting general location only) detecting true and proximity sensor 430*a* detecting false. Similarly, proximity sensors 435*a* (not shown, reference numeral depicting general location only) and 435*b* (not shown, reference numeral depicting general location only) may be monitored to determine the location and movement of lower sealing element 230*b*. The plurality of locking dogs 415 (not shown, reference numeral depicting general location only) disposed below the bottom side of the upper annular packer system 200*a* may be unlocked. Then, while lower annular packer 210*b* of lower annular packer system 200*b* maintains the pressure tight seal on the annulus surrounding running tool 530, upper sealing element 230*a* and lower sealing element 230*b* may be stripped out. Once one or more of the sealing elements, either 230*a* alone or both 230*a* and 230*b*, are retrieved, replacement sealing elements, 230*a* or 230*a* and 230*b*, may be deployed within annular sealing system 400.

One of ordinary skill in the art will recognize that, while the above-noted description described the retrieval of both upper sealing element 230*a* and lower sealing element 230*b* during a single run of running tool 530, the operation could easily be modified to retrieve only upper sealing element 230*a* in a similar manner to that described above. For example, upper annular packer system 200*a* may be disengaged such that upper sealing element 230*a* unseals the annulus surrounding running tool 530. The pressure of intermediate area 405 may be equalized with marine riser pressure above upper annular packer 200*a*. The plurality of locking dogs 410 (not shown, reference numeral depicting general location only) disposed above the top side of the upper annular packer system 200*a* may be unlocked. Running tool 530 may then strip out with upper sealing element 230*a* only. In such an application, lower sealing element 230*b* may independently maintain the annular seal surrounding running tool 530 while upper sealing element 230*a* alone is retrieved.

Figure 6A:
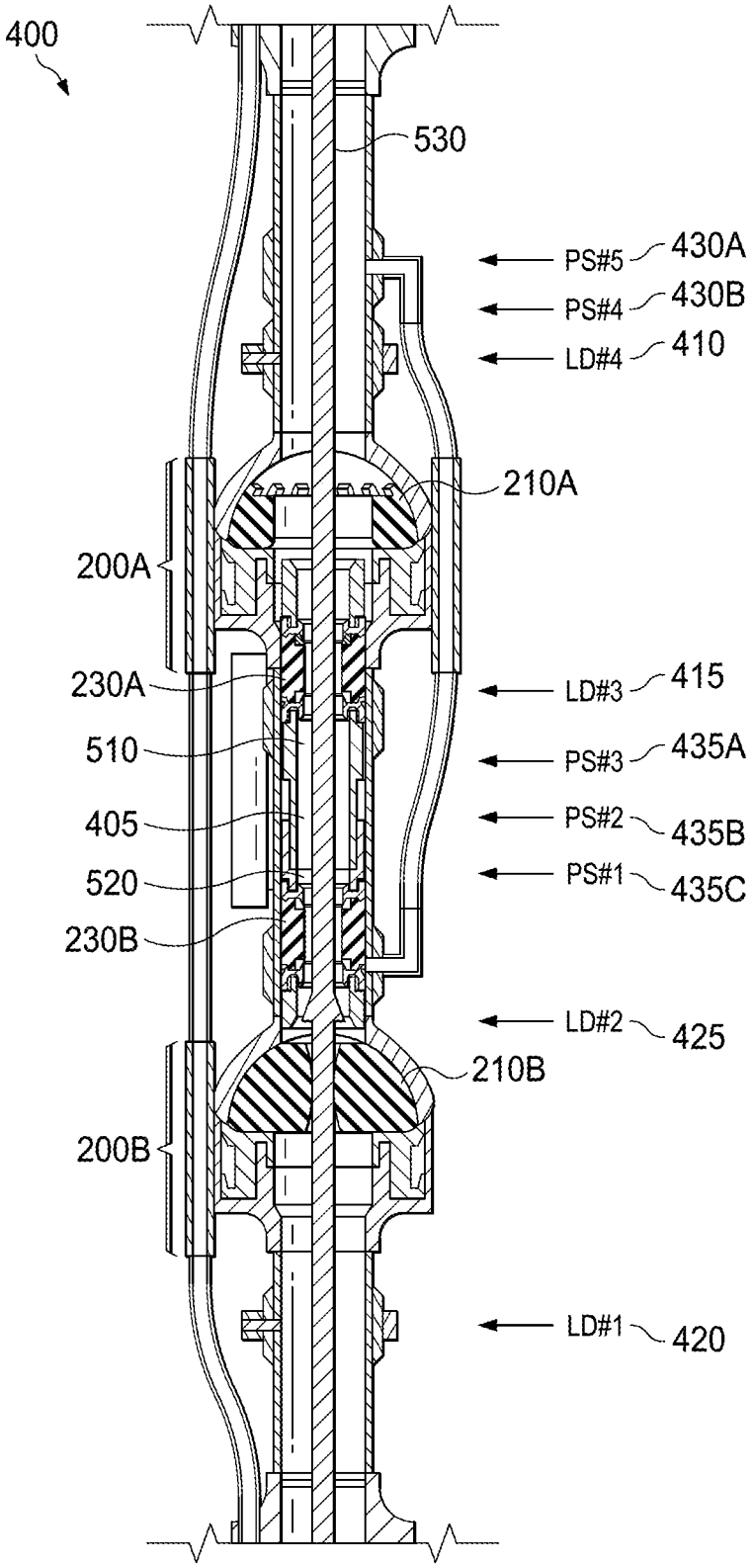
FIG. 6A shows a cross-sectional view of a running tool stripping in an ACD-type annular sealing system with a replacement upper sealing element and a replacement lower sealing element on the running tool while a lower packer of the annular sealing system seals the annulus surrounding the running tool in accordance with one or more embodiments of the present invention.
Figure 6B:
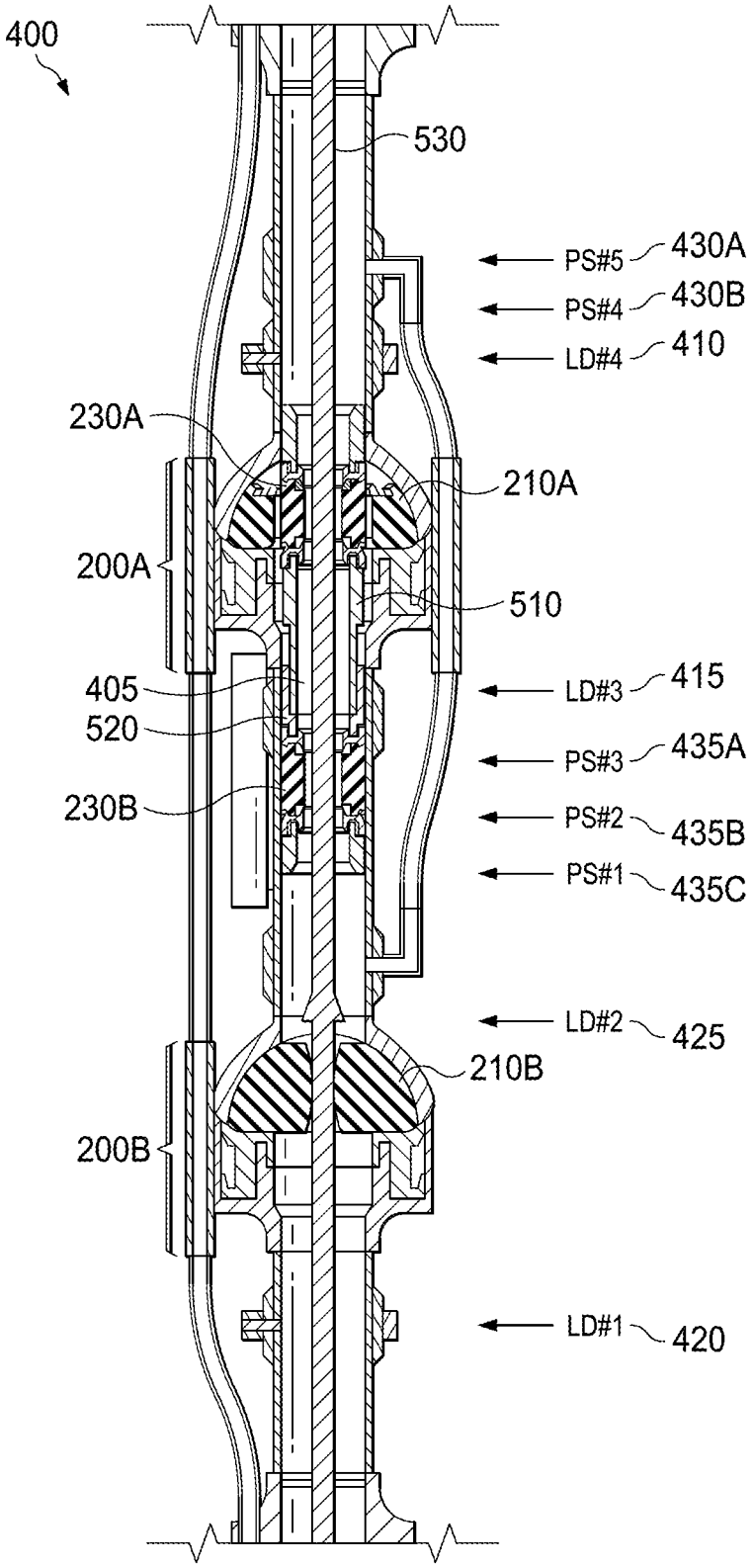
FIG. 6B shows a cross-sectional view of the running tool positioning the upper sealing element relative to an upper annular packer system of the annular sealing system while the lower annular packer system seals the annulus surrounding the running tool in accordance with one or more embodiments of the present invention.

FIG. 6A shows a cross-sectional view of a running tool 530 stripping in an ACD-type annular sealing system 400 with a replacement upper sealing element 230*a* and a replacement lower sealing element 230*b* on running tool 530 while a lower annular packer 210*b* of a lower annular packer system 200*b* seals the annulus surrounding running tool 530 in accordance with one or more embodiments of the present invention. Continuing, FIG. 6B shows a cross-sectional view of running tool 530 positioning upper sealing element 230*a* relative to upper annular packer system 200*a* of annular sealing system 400, while lower annular packer 210*b* of lower annular packer system 200*b* seals the annulus surrounding running tool 530 in accordance with one or more embodiments of the present invention. Running tool 530 may be used to position replacement upper sealing element 230*a* in place relative to upper annular packer system 200*a*. A plurality of locking dogs 415 (not shown, reference numeral depicting general location only) disposed below the bottom side of upper annular packer system 200*a* may be locked and a plurality of locking dogs 410 (not shown, reference numeral depicting general location only) disposed above the top side of upper annular packer system 200*a* may be locked to secure replacement upper sealing element 230*a* in place relative to upper annular packing system 200*a*. Upper annular packer system 200*a* may be engaged to seal the annulus surrounding running tool 530 with upper sealing element 230*a*.

Figure 6C:
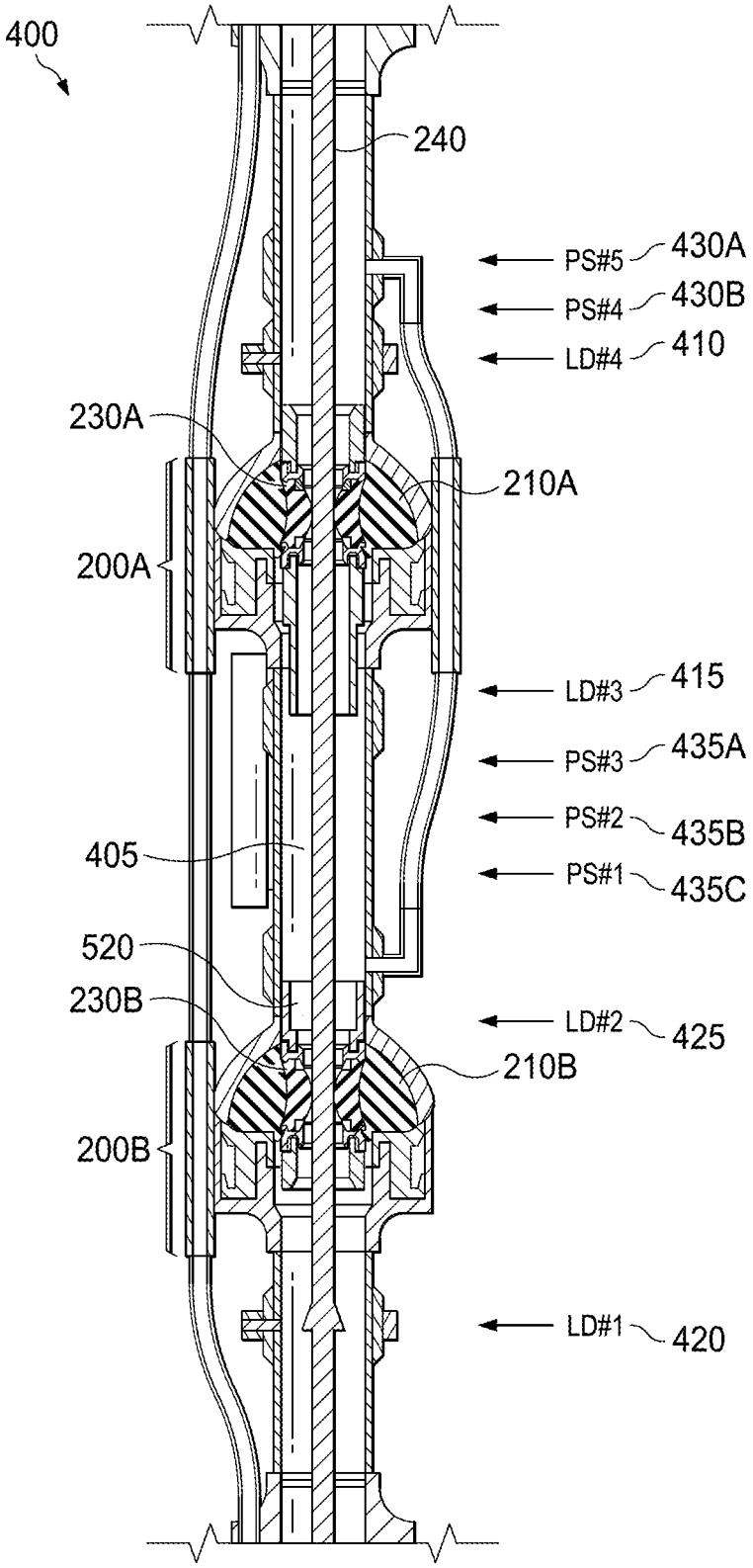
FIG. 6C shows a cross-sectional view of the upper sealing element and the lower sealing element engaged by the upper annular packer system and the lower annular packer system respectively to seal the annulus surrounding the running tool in accordance with one or more embodiments of the present invention.

The pressure in the intermediate area may be equalized with wellbore pressure. Lower annular packer system 200*b* may be disengaged to unseal the annulus surrounding running tool 530. Running tool 530 may strip in to position replacement lower sealing element 230*b* in place relative to lower annular packer system 200*b* by setting it down on the plurality of locking dogs 420 (not shown, reference numeral depicting general location only) disposed below lower annular packer system 200*b*. A plurality of locking dogs 425 (not shown, reference numeral depicting general location only) disposed above the top side of lower annular packer system 200*b* may be locked. The setting may be tested by pulling up on running tool 530. Continuing, FIG. 6C shows a cross-sectional view of upper sealing element 230*a* and lower sealing element 230*b* engaged by upper annular packer system 200*a* and lower annular packer system 200*b* respectively to seal the annulus surrounding running tool 530 with a dual seal in accordance with one or more embodiments of the present invention. Lower annular packer system 200*b* may be engaged to seal the annulus surrounding running tool 530 with lower sealing element 230*b*. Running tool 530 may be stripped out, a dual seal lubrication cycle may be initiated, and a stand of drill pipe 240 may be stripped in, all while annular sealing system 400 maintains a pressure tight seal on the annulus. Once complete, drilling activities may resume.

One of ordinary skill in the art will recognize that, while the above-noted description described the deployment of both upper sealing element 230*a* and lower sealing element 230*b* during a single run of running tool 530, the operation could easily be modified to deploy only upper sealing element 230*a* in a similar manner to that described above. For example, upper annular packer system 200*a* may be disengaged. The pressure of intermediate area 405 may be equalized with marine riser pressure above upper annular packer 200*a*. The plurality of locking dogs 410 (not shown, reference numeral depicting general location only) disposed above the top side of the upper annular packer system 200*a* may be unlocked. Running tool 530 may then strip in with upper sealing element 230*a* only until upper sealing element 230*a* comes to rest on the plurality of locking dogs 415 (not shown, reference numeral depicting general location only) disposed below the bottom side of upper packer system 200*a*. The plurality of locking dogs 410 (not shown, reference numeral depicting general location only) may be locked to secure upper sealing element 230*a* in place. In such an application, lower sealing element 230*b* may independently maintain the annular seal surrounding running tool 530 while upper sealing element 230*a* alone is deployed.

Figure 7A:
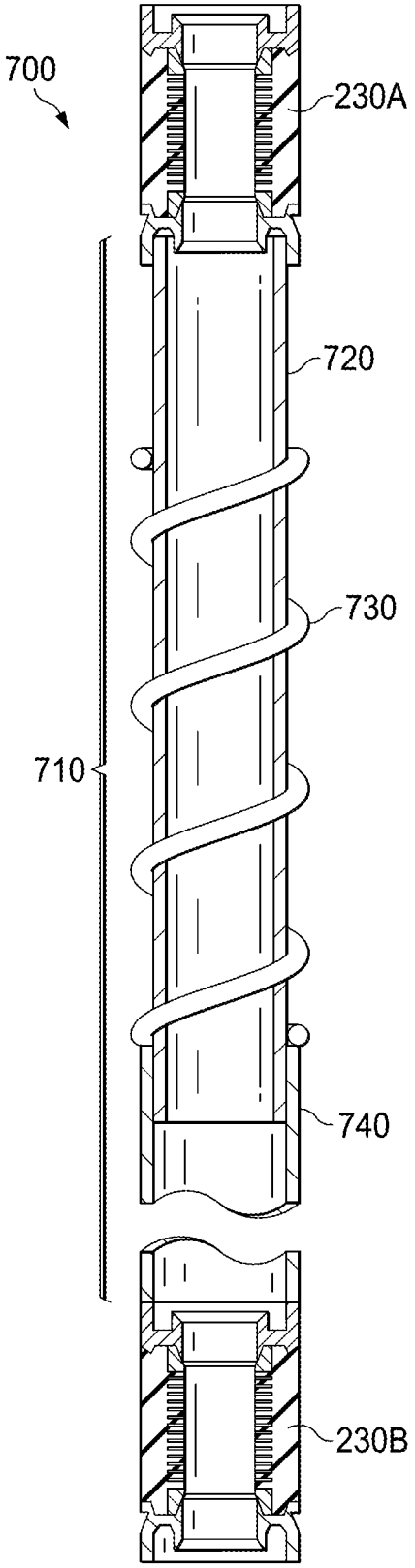
FIG. 7A shows a cross-sectional view of an upper sealing element and a lower sealing element of an ACD-type annular sealing system disposed on opposing ends of a spring-biased mandrel in a biased state (stretched) in accordance with one or more embodiments of the present invention.

FIG. 7A shows a cross-sectional view of an upper sealing element 230*a* and a lower sealing element 230*b* of an ACD-type annular sealing system (e.g., 400 of FIG. 4) disposed on opposing ends of a spring-biased mandrel 710 in a biased state (stretched) in accordance with one or more embodiments of the present invention. In certain embodiments, upper sealing element 230*a* and lower sealing element 230*b* may be composed of a urethane matrix co-molded with a PTFE cage. One of ordinary skill in the art will recognize that other materials and compositions may be used in accordance with one or more embodiments of the present invention. Upper sealing element 230*a* may be attached to a top portion 720 of spring-biased mandrel 710 and lower sealing element 230*b* may be attached to a bottom portion 740 of spring-biased mandrel 710. Top portion 720 of spring-biased mandrel 710 may have a telescopic arrangement with bottom portion 740 that is biased with a spring 730. In a biased state, spring 730 is stretched or extended such that the telescopic arrangement between top portion 720 and bottom portion 740 of spring-biased mandrel 710 is in a stretched or extended state.

Figure 7B:
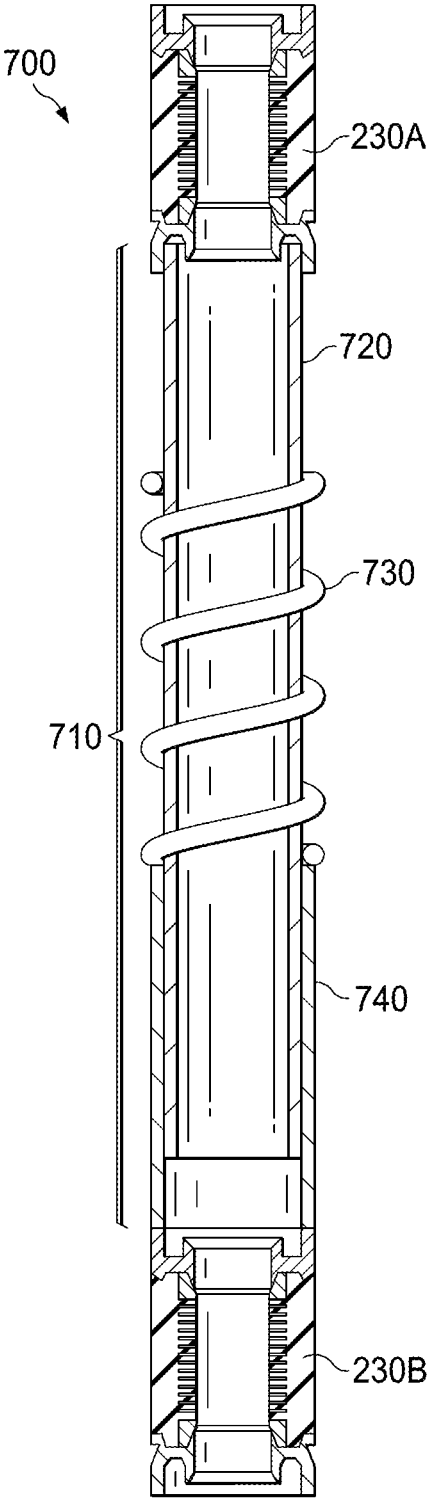
FIG. 7B shows a cross-sectional view of the upper sealing element and the lower sealing element disposed on opposing ends of the spring-biased mandrel in an unbiased (regular) state in accordance with one or more embodiments of the present invention.

Continuing, FIG. 7B shows a cross-sectional view of upper sealing element 230*a* and lower sealing element 230*b* disposed on opposing ends of spring-biased mandrel 710 in an unbiased (regular) state in accordance with one or more embodiments of the present invention. In the un-biased state, spring 730 retracts to its natural unbiased position such that the telescopic arrangement between top portion 720 and bottom portion 740 of spring-biased mandrel 710 is in a retracted or natural state.

Each sealing element 230*a*, 230*b* may be substantially cylindrical in shape and have an inner diameter that may receive drill pipe (not shown) therethrough with a close fit. During drilling operations, one or more of upper sealing element 230*a* and lower sealing element 230*b* may be engaged to provide an interference fit that seals the annulus (not shown) surrounding the drill pipe (not shown). Conventional ACD-type annular sealing systems (not shown) use a dual seal sleeve including two sealing elements (not shown) disposed on opposing ends of a single mandrel (not shown) that are engaged at the same time to provide redundant sealing and increase the safety of operations. In contrast, in one or more embodiments of the present invention, upper sealing element 230*a* and lower sealing element 230*b* may be independently engaged or disengaged and independently moved in between bit runs while the annular sealing system (e.g., 400 of FIG. 4) maintains the pressure tight seal on the annulus (not shown). Advantageously, in such embodiments, upper sealing element 230*a* and lower sealing element 230*b* may be retrieved or deployed with a single run of a running tool while maintaining annular pressure as described herein.

In operation, upper sealing element 230*a* and lower sealing element 230*b*, disposed on opposing ends of spring-biased mandrel 710, may be disposed within the annular sealing system (e.g., 400 of FIG. 4). Upper sealing element 230*a* may be positioned for engagement by upper annular packer system 200*a* and lower sealing element 230*b* may be positioned for engagement by lower annular packer system 200*b* such that spring-biased mandrel 710 is in an extended, or biased, state. Drill pipe (not shown) may be disposed through an inner diameter of the annular sealing system (e.g., 400 of FIG. 4). The annular sealing system (e.g., 400 of FIG. 4) may be engaged and the marine riser may be pressurized by engaging one or more of upper sealing element 230*a* and lower sealing element 230*b* by upper annular packer system 200*a* and lower annular packer system 200*b* respectively. In typical applications, upper sealing element 230*a* and lower sealing element 230*b* may be engaged at the same time to provide a redundant seal. For reasons beyond the scope of this disclosure, one of the sealing elements 230*a*, 230*b* may wear at a faster rate than the other (typically the upper sealing element 230*a*). If one of the sealing elements 230*a* or 230*b* wears out in between bit runs, the worn sealing element 230*a* or 230*b* must be replaced, causing a premature end to drilling activities, requiring substantial non-productive downtime, and the time-consuming, complex, and costly task of depressurizing the marine riser (not shown). As such, it is highly desirable to be able to replace the worn sealing element 230*a* or 230*b* without depressurizing the marine riser (not shown), thereby minimizing non-productive downtime and safely maintaining marine riser (not shown) pressure. In one or more embodiments of the present invention, when a decision has been taken to replace a worn sealing element 230*a* or 230*b*, a stand of drill pipe (not shown) may be stripped out of upper sealing element 230*a* and lower sealing element 230*b*.

Figure 7C:
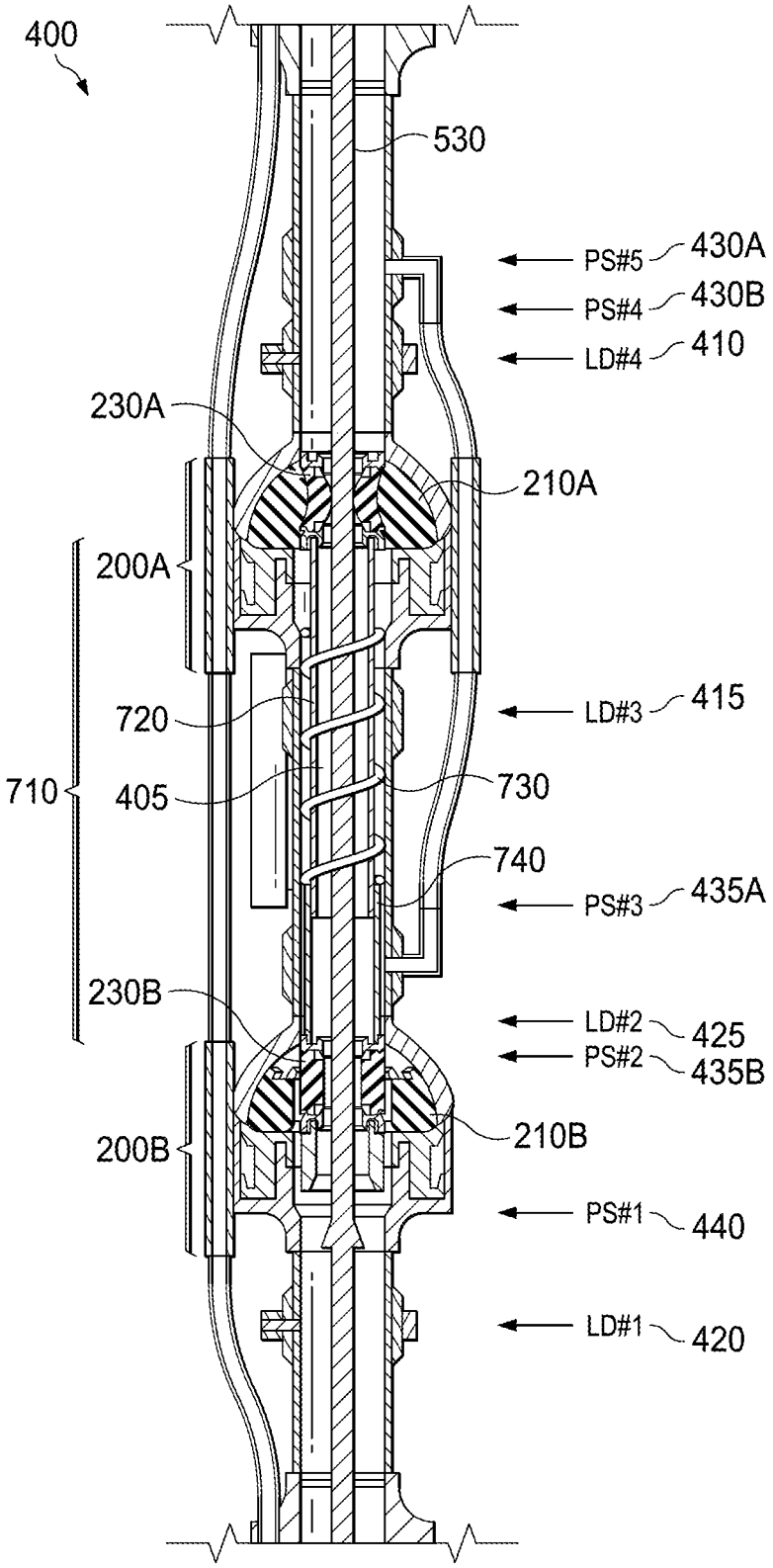
FIG. 7C shows a cross-sectional view of a running tool stripping in through the annular sealing system with the upper sealing element and the lower sealing element disposed on opposing ends of the spring-biased mandrel in biased state in accordance with one or more embodiments of the present invention.
Figure 7D:
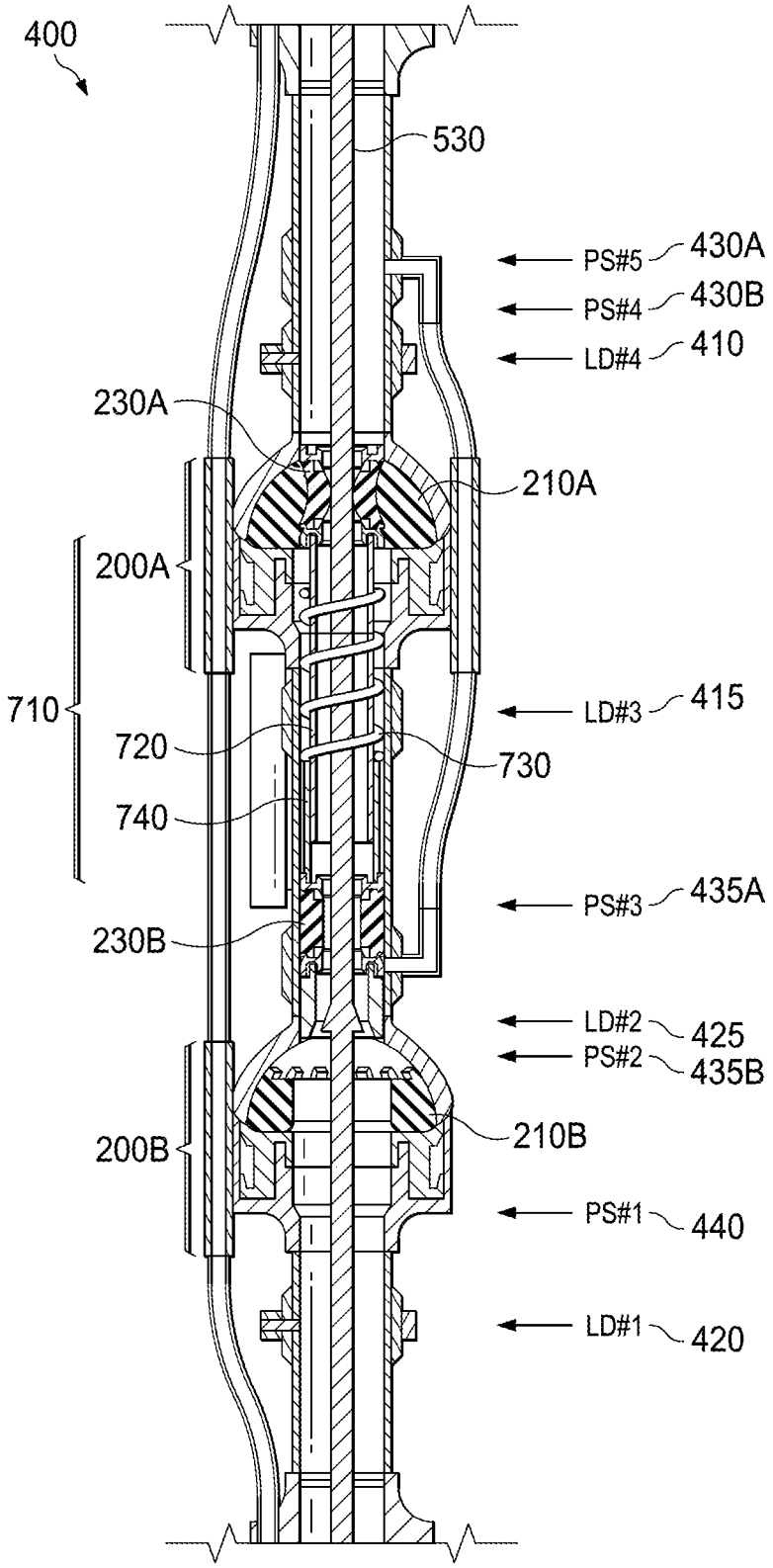
FIG. 7D shows a cross-sectional view of the upper sealing element sealing the annulus surrounding the running tool, a lower annular packer system of the annular sealing system disengaged, and the lower sealing element moving into an intermediate area of the annular sealing system as the spring returns to the unbiased state in accordance with one or more embodiments of the present invention.

Continuing, FIG. 7C shows a cross-sectional view of a running tool 530 stripping in annular sealing system 400 through upper sealing element 230*a* and lower sealing element 230*b* disposed on opposing ends of spring-biased mandrel 710 in biased state in accordance with one or more embodiments of the present invention. Upper annular packer system 200*a* may be engaged, if not already engaged, to seal the annulus surrounding running tool 530 with upper sealing element 230*a*. Lower annular packer system 200*b* may be disengaged to unseal the annulus surrounding running tool 530 with lower sealing element 230*b*. Continuing FIG. 7D shows a cross-sectional view of upper sealing element 230*a* sealing the annulus surrounding running tool 530, a lower annular packer system 200*b* of annular sealing system 400 disengaged, and lower sealing element 230*b* moving into an intermediate area 405 of annular sealing system 400 as spring 730 returns to the unbiased state in accordance with one or more embodiments of the present invention. Specifically, a plurality of locking dogs 425 (not shown, reference numeral depicting general location only) disposed above the top side of lower annular packer system 200*b* may be unlocked such that the spring-biased mandrel 710 retracts lower sealing element 230*b* into the intermediate area 405 within annular sealing system 400 between a plurality of locking dogs 415 (not shown, reference numeral depicting general location only) disposed below the bottom side of upper annular packer system 400 and the plurality of locking dogs 425 (not shown, reference numeral depicting general location only) disposed above the top side of lower annular packer system 400. The location of lower sealing element 230*b* may be determined by monitoring one or more proximity sensors, such as, for example, proximity sensor 435*a* (not shown, reference numeral depicting general location only) detecting true.

Figure 7E:
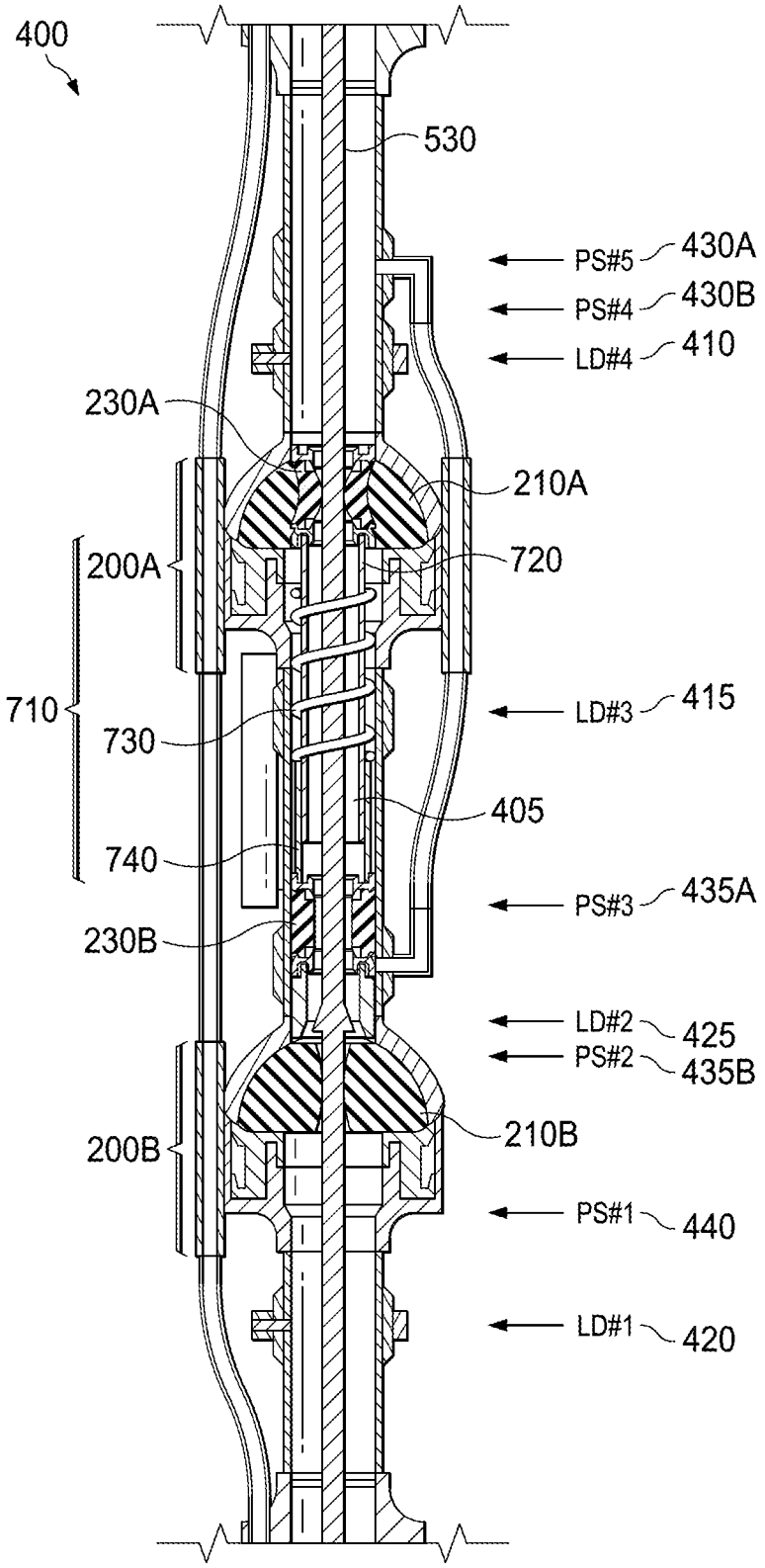
FIG. 7E shows a cross-sectional view of the lower annular packer system engaged to seal the annulus surrounding the running tool, the upper annular packer system engaged to seal the annulus surrounding the running tool with the upper sealing element, and the lower sealing element moved fully into the intermediate area of the annular sealing system in accordance with one or more embodiments of the present invention.
Figure 7F:
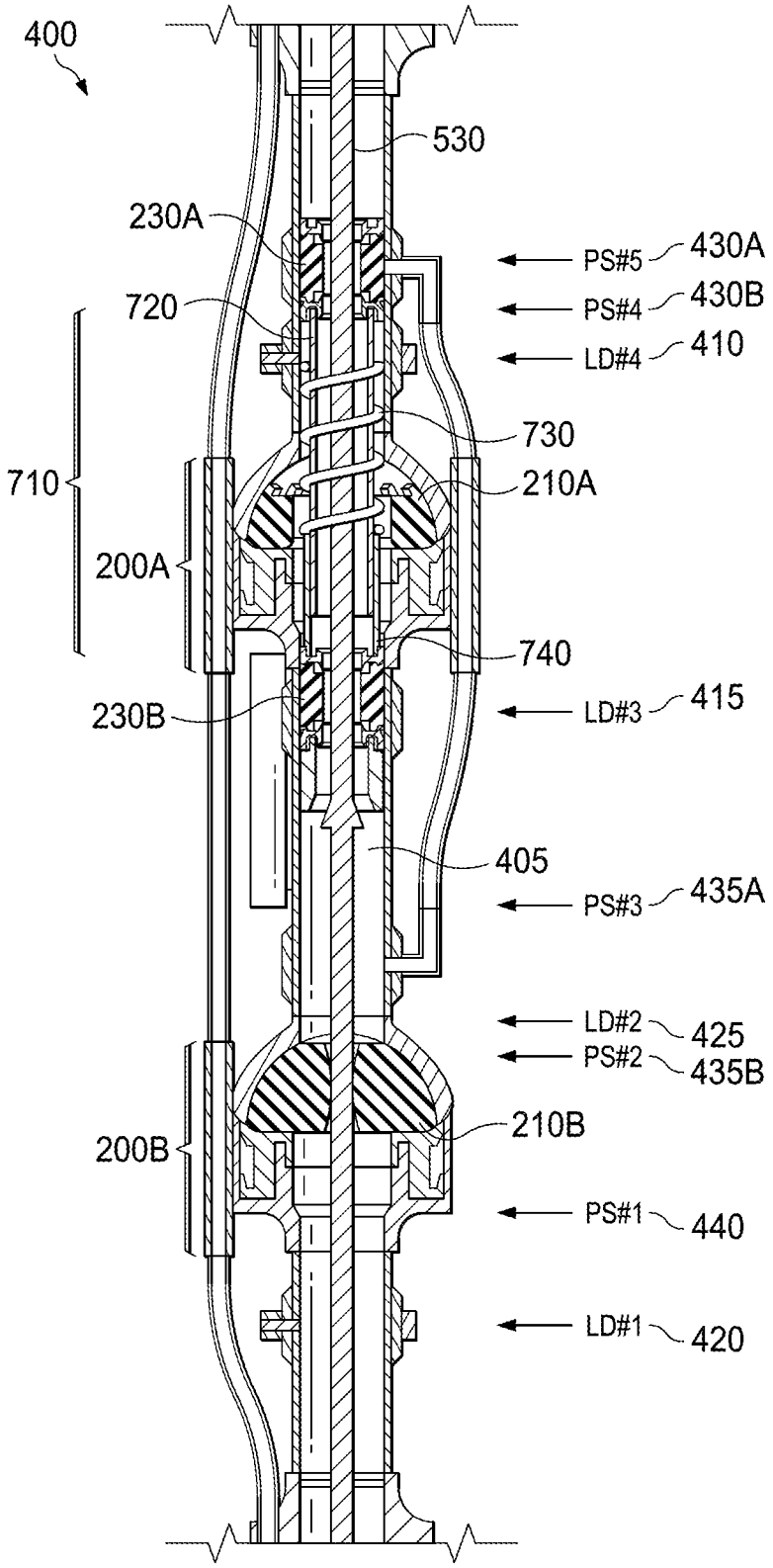
FIG. 7F shows a cross-sectional view of the running tool being stripped out of the hole with the upper sealing element and the lower sealing element disposed on opposing ends of the spring-biased mandrel while the lower annular packer system seals the annulus surrounding the running tool in accordance with one or more embodiments of the present invention.

Continuing, FIG. 7E shows a cross-sectional view of lower annular packer system 200*b* engaged to seal the annulus surrounding running tool 530, upper annular packer system 200*a* engaged to seal the annulus surrounding running tool 530 with upper sealing element 230*a*, and lower sealing element 230*b* moved fully into intermediate area 405 of annular sealing system 400 in accordance with one or more embodiments of the present invention. The plurality of locking dogs 425 disposed above the top side of lower annular packer system 200*b* may be locked. Lower annular packer system 200*b* may be engaged to seal the annulus surrounding running tool 530 with lower annular packer 210*b*. Continuing FIG. 7F shows a cross-sectional view of running tool 530 being stripped out of the hole with upper sealing element 230*a* and lower sealing element 230*b* disposed on opposing ends of spring-biased mandrel 710 while lower annular packer system 200*b* seals the annulus surrounding running tool 530 with lower annular packer 210*b* in accordance with one or more embodiments of the present invention. The pressure of intermediate area 405 may be equalized with marine riser pressure above upper annular packer system 200*a* and upper annular packer system 200*a* may be disengaged to unseal the annulus surrounding running tool 530 with upper sealing element 230*a*. A plurality of locking dogs 410 (not shown, reference numeral depicting general location only) disposed above the top side of upper annular packer system 200*a* may be unlocked. Running tool 530 may be stripped out until upper sealing element 230*a* clears upper annular packer system 200*a*, which may be confirmed by pulling until proximity sensor 430*b* detects true and proximity sensor 430*a* detects false. A plurality of locking dogs 415 disposed below the bottom side of upper annular packer system 200*a* may be unlocked. Running tool 530 may then be stripped out with upper sealing element 230*a* and lower sealing element 230*b* disposed on opposing ends of spring-biased mandrel 710 on running tool 530.

Figure 8A:
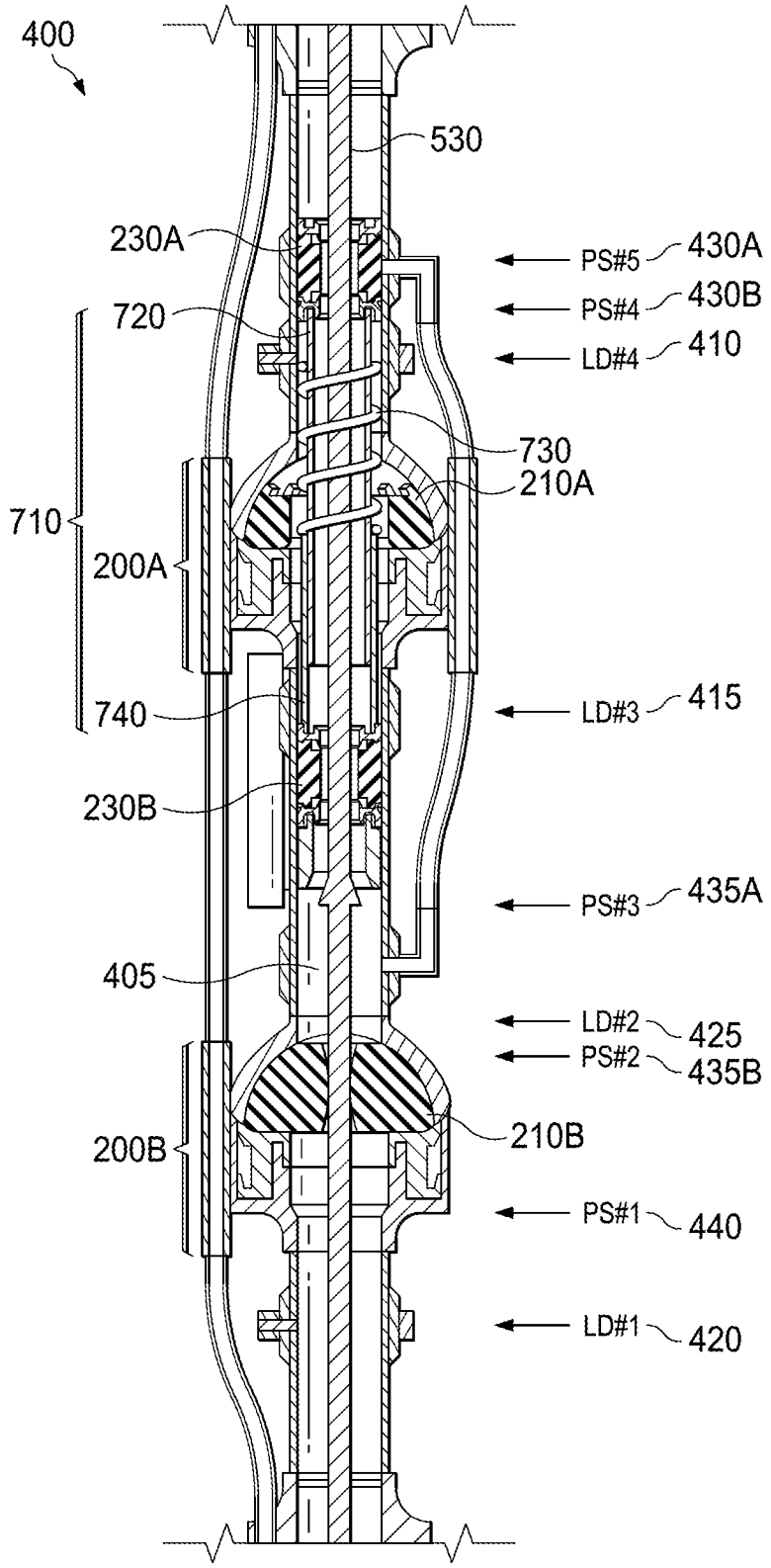
FIG. 8A shows a cross-sectional view of a running tool stripping in an ACD-type annular sealing system with a replacement upper sealing element and a replacement lower sealing element disposed on opposing ends of a replacement spring-biased mandrel in a unbiased state, an upper annular packer system of the annular sealing system disengaged, and a lower annular packer system of the annular sealing system sealing the annulus surrounding the running tool in accordance with one or more embodiments of the present invention.

FIG. 8A shows a cross-sectional view of a running tool 530 stripping in an ACD-type annular sealing system 400 with a replacement upper sealing element 230*a* and a replacement lower sealing element 230*b* disposed on opposing ends of a replacement spring-biased mandrel 710 in a unbiased state, an upper annular packer system 200*a* of annular sealing system 400 disengaged, and a lower annular packer system 200*b* of annular sealing system 400 sealing the annulus surrounding running tool 530 in accordance with one or more embodiments of the present invention. A plurality of locking dogs 425 (not shown, reference numeral depicting general location only) disposed above the top side of lower annular packer system 200*b* may be locked, if they are not already locked. Running tool 530 may be manipulated to set replacement upper sealing element 230*a* within upper annular packer system 200*a*. The location of upper sealing element 230*a* may be confirmed by proximity sensor 430*b* (not shown, reference numeral depicting general location only) detecting true while proximity sensor 430*a* (not shown, reference numeral depicting general location only) is detecting false. A plurality of locking dogs 415 (not shown, reference numeral depicting general location only) disposed below the bottom side of upper annular packer system 200*a* may be locked. Upper sealing element 230*a* may be set down on locking dogs 415 (not shown, reference numeral depicting general location only). A plurality of locking dogs 410 (not shown, reference numeral depicting general location only) disposed above the top side of upper annular packer system 200*a* may be locked thereby securing upper sealing element 230*a* in place. The position of upper sealing element 230*a* relative to upper annular packer system 230*a* may be confirmed by one or more proximity sensors 430 (not shown, reference numeral depicting general location only).

Figure 8B:
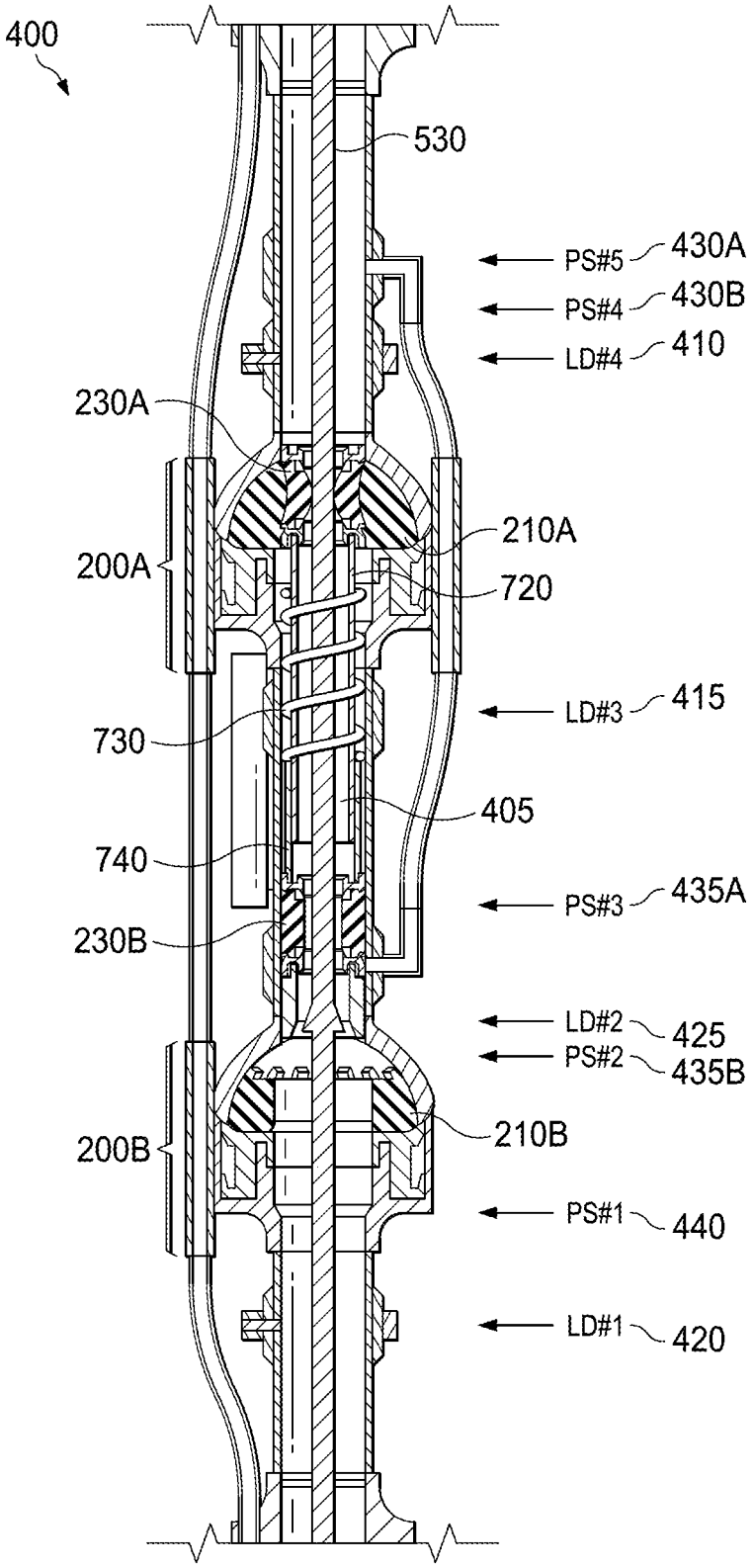
FIG. 8B shows a cross-sectional view of the running tool stripping in the annular sealing system with the upper sealing element and the lower sealing element disposed on opposing ends of the spring-biased mandrel in a unbiased state, with the upper sealing element sealing the annulus surrounding the running tool, and the lower annular packer system disengaged in accordance with one or more embodiments of the present invention.

Continuing, FIG. 8B shows a cross-sectional view of running tool 530 stripping in annular sealing system 400 with upper sealing element 230*a* and lower sealing element 230*b* disposed on opposing ends of spring-biased mandrel 710 in a unbiased state, with upper sealing element 230*a* sealing the annulus surrounding running tool 530, and lower annular packer system 200*b* disengaged in accordance with one or more embodiments of the present invention. Upper annular packer system 200*a* may be engaged to seal the annulus surrounding running tool 530 with upper sealing element 230*a*. The pressure of intermediate area 405 may be equalized with wellbore pressure. Once equalized, lower annular packer system 200*b* may be disengaged to unseal the annulus surrounding running tool 530 with lower annular packer 210*b*.

Figure 8C:
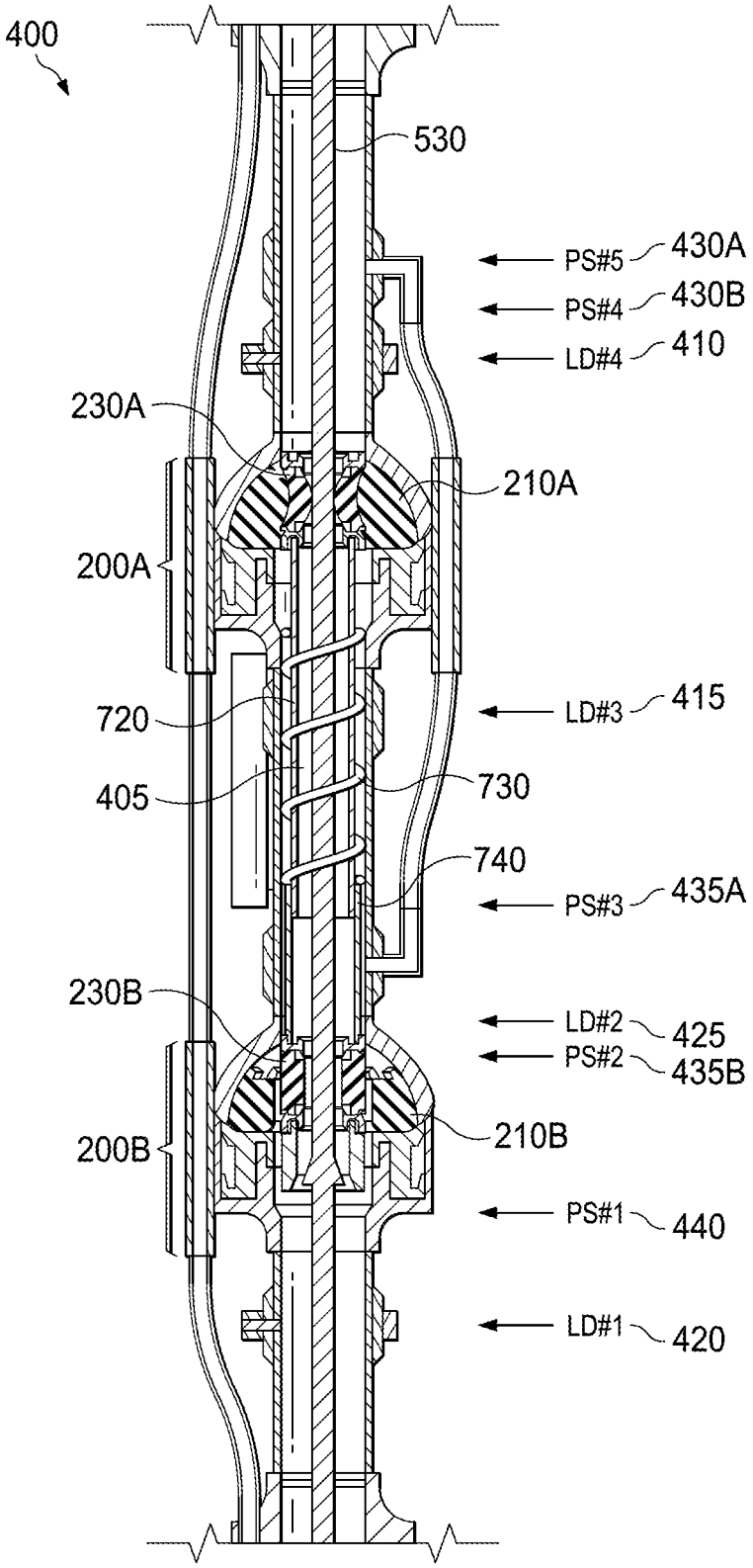
FIG. 8C shows a cross-sectional view of the running tool stripping in the annular sealing system with the upper sealing element and the lower sealing element disposed on opposing ends of the spring-biased mandrel in a biased state with the upper sealing element engaged, the lower sealing element positioned relative to the lower annular packer system, and the lower annular packer system in a disengaged state in accordance with one or more embodiments of the present invention.

Continuing, FIG. 8C shows a cross-sectional view of running tool 530 stripping in annular sealing system 400 with upper sealing element 230*a* and lower sealing element 230*b* disposed on opposing ends of spring-biased mandrel 710 in a biased state with upper sealing element 230*a* engaged, lower sealing element 230*b* positioned relative to lower annular packer system 200*b*, and lower annular packer system 200*b* in a disengaged state in accordance with one or more embodiments of the present invention. A plurality of locking dogs 425 disposed above the top side of lower annular packer system 200*b* may be unlocked. Running tool 530 may strip in until lower sealing element 230*b* is set in place relative to lower annular packer system 200*b*. This may be detected by a decrease in weight-on-bit which suggests lower sealing element 230*b* is sitting on top of locking dogs 420 (not shown, reference numeral depicting general location only). For example, proximity sensor 440 (not shown, reference numeral depicting general location only) may detect true, proximity sensor 435*b* (not shown, reference numeral depicting general location only) may detect true, and proximity sensor 435*a* (not shown, reference numeral depicting general location only) may detect false. The plurality of locking dogs 425 disposed above the top side of lower annular packer system 200*b* may be locked to secure lower sealing element 230*b* in place. The position of lower sealing element 230*b* relative to lower annular packer system 230*b* may be confirmed by one or more proximity sensors 435, 440 (not shown, reference numeral depicting general location only).

Figure 8D:
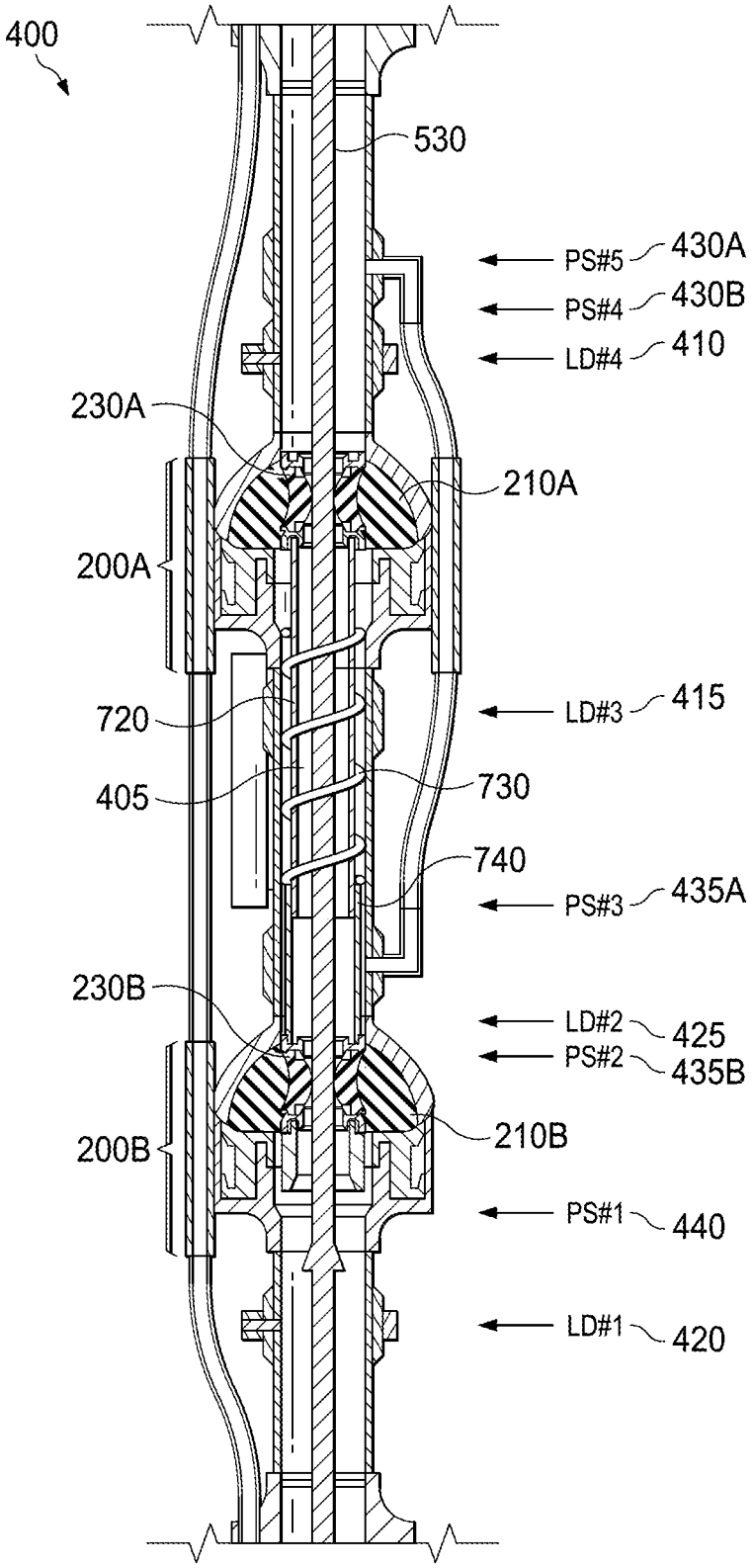
FIG. 8D shows a cross-sectional view of the running tool stripping out of the annular sealing system, the upper sealing element, and the lower sealing element while the upper sealing element and the lower sealing element are engaged to seal the annulus surrounding the running tool in accordance with one or more embodiments of the present invention.

Continuing, FIG. 8D shows a cross-sectional view of running tool 530 stripping out of annular sealing system 400, upper sealing element 230*a*, and lower sealing element 230*b* while upper sealing element 230*a* and lower sealing element 230*b* are engaged to seal the annulus surrounding running tool 530 in accordance with one or more embodiments of the present invention. At this point, spring 730 may be stretched out such that spring-biased mandrel 710 is in a biased, or extended, state. Lower annular packer system 200*b* may be engaged to seal the annulus surrounding running tool 530 with lower sealing element 230*b*. Running tool 530 may be stripped out, seal lubrication may be initiated, and a stand of drill pipe (not shown) may then be stripped back in while maintaining the annular seal. Once complete, drilling activities may resume.

Figure 9A:
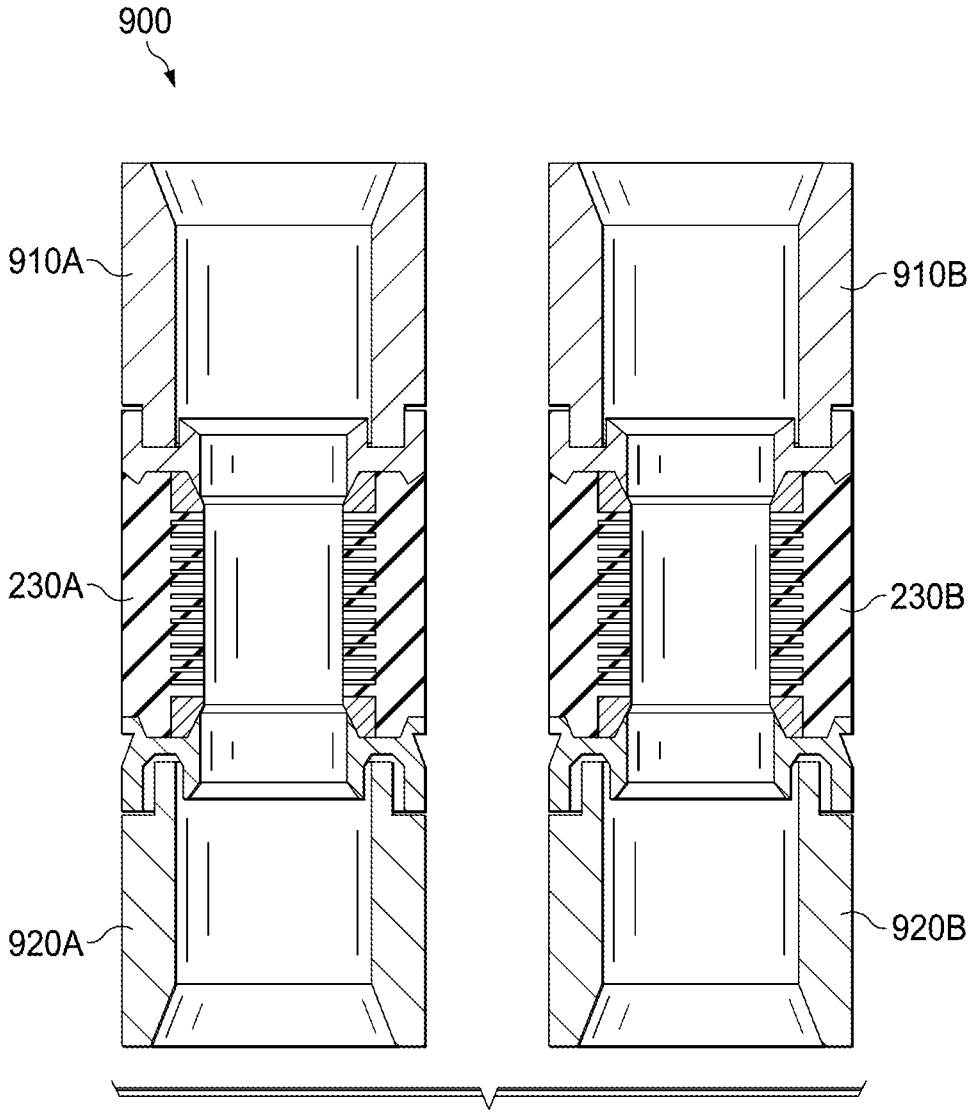
FIG. 9A shows a cross-sectional view of an independent upper sealing element and an independent lower sealing element for an ACD-type annular sealing system in accordance with one or more embodiments of the present invention.

FIG. 9A shows a cross-sectional view of an independent upper sealing element 230*a* and an independent lower sealing element 230*b* for an ACD-type annular sealing system (e.g., 400 of FIG. 4) in accordance with one or more embodiments of the present invention. In certain embodiments, upper sealing element 230*a* and lower sealing element 230*b* may be composed of a urethane matrix co-molded with a PTFE cage. One of ordinary skill in the art will recognize that other materials and compositions of material may be used in accordance with one or more embodiments of the present invention. A first distal end of upper sealing element 230*a* may be attached to a first spacer portion 910*a* and a second distal end may be attached to a second spacer portion 920*a*. Similarly, a first distal end of lower sealing element 230*b* may be attached to a first spacer portion 910*b* and a second distal end may be attached to a second spacer portion 920*b*. Upper sealing element 230*a* and associated spacer portions 910*a* and 920*a* are completely independent from lower sealing element 230*b* and associated spacer portions 910*b* and 920*b*.

Each sealing element 230*a*, 230*b* may be substantially cylindrical in shape and have an inner diameter that may receive drill pipe (not shown) therethrough with a close fit. During drilling operations, one or more of upper sealing element 230*a* and lower sealing element 230*b* may be engaged to provide an interference fit that seals the annulus (not shown) surrounding the drill pipe (not shown). Conventional ACD-type annular sealing systems (not shown) use a dual seal sleeve configuration including two sealing elements (not shown) disposed on opposing ends of a single mandrel (not shown) that are engaged at the same time to provide redundant sealing and increase the safety of operations. In contrast, in one or more embodiments of the present invention, upper sealing element 230*a* and lower sealing element 230*b* may be independently engaged or disengaged and independently moved in between bit runs while the annular sealing system (e.g., 400 of FIG. 4) maintains the pressure tight seal on the annulus (not shown). Advantageously, in such embodiments, upper sealing element 230*a* may be retrieved independently with a single run of a running tool or, once upper sealing element 230*a* has been removed, lower sealing element 230*b* may be retrieved independently with a single run of the running tool, all while maintaining annular pressure as described herein. However, similar to embodiments previously described, both sealing elements 230*a* and 230*b* could potentially be retrieved with a single run of running tool 530.

In operation, independently controllable upper sealing element 230*a* and independently controllable lower sealing element 230*b* may be disposed within the annular sealing system (e.g., 400 of FIG. 4). Upper sealing element 230*a* may be positioned for engagement by upper annular packer system 200*a* and lower sealing element 230*b* may be positioned for engagement by lower annular packer system 200*b*. Drill pipe (not shown) may be disposed through an inner diameter of the annular sealing system (e.g., 400 of FIG. 4). The annular sealing system (e.g., 400 of FIG. 4) may be engaged and the marine riser may be pressurized by engaging one or more of upper sealing element 230*a* and lower sealing element 230*b* by upper annular packer 200*a* and lower annular packer 200*b* respectively.

In typical applications, upper sealing element 230*a* and lower sealing element 230*b* are engaged at the same time to provide a redundant seal. For reasons beyond the scope of this disclosure, one of sealing elements 230*a* or 230*b* may wear at a faster rate than the other (typically the upper sealing element 230*a*). If one of sealing elements 230*a* or 230*b* wears out in between bit runs, the worn sealing element 230*a* or 230*b* must be replaced, causing a premature end to drilling activities, requiring substantial non-productive downtime, and the time-consuming, complex, and costly task of depressurizing the marine riser (not shown). As such, it is highly desirable to be able to replace the worn sealing element 230*a* or 230*b* without depressurizing the marine riser (not shown), thereby minimizing non-productive downtime and safely maintaining marine riser (not shown) pressure. In one or more embodiments of the present invention, when a decision has been taken to replace a worn sealing element 230*a* or 230*b*, a stand of drill pipe (not shown) may be stripped out of upper sealing element 230*a* and lower sealing element 230*b*.

Figure 9B:
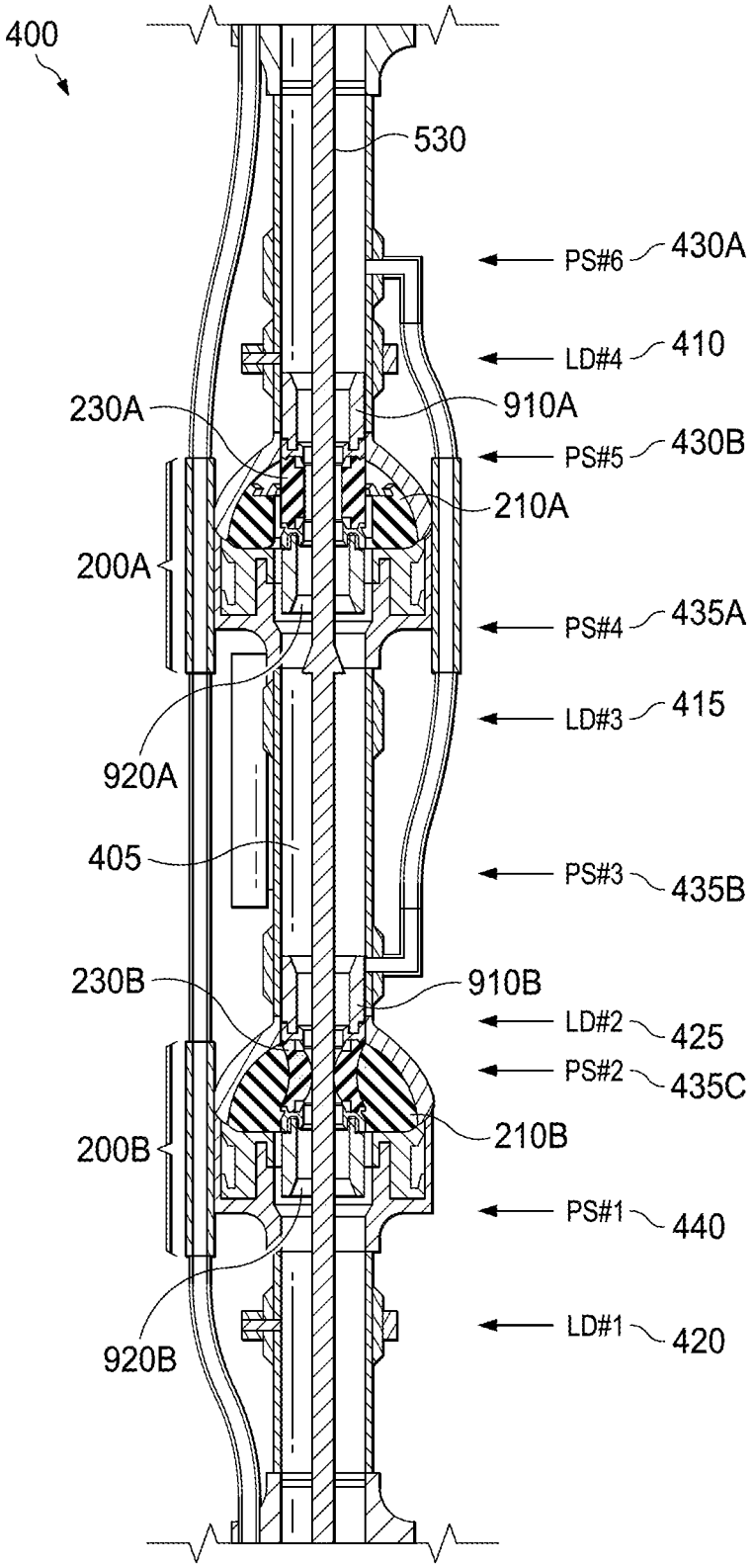
FIG. 9B shows a cross-sectional view of a running tool stripping in the annular sealing system with the upper sealing element disengaged and the lower sealing element sealing the annulus surrounding the running tool in accordance with one or more embodiments of the present invention.

Continuing, FIG. 9B shows a cross-sectional view of a running tool 530 stripping in annular sealing system 400 with upper sealing element 230*a* disengaged and lower sealing element 230*b* sealing the annulus surrounding running tool 530 in accordance with one or more embodiments of the present invention. If not already engaged, a lower annular packer 210*b* of lower annular packer system 200*b* may be fully engaged to seal the annulus surrounding running tool 530. Upper packer system 200*a* may be disengaged to unseal the annulus surrounding running tool 530 with upper sealing element 230*a*. A plurality of locking dogs 410 (not shown, reference numeral depicting general location only) disposed above the top side of upper annular packer system 200*a* may be unlocked.

Figure 9C:
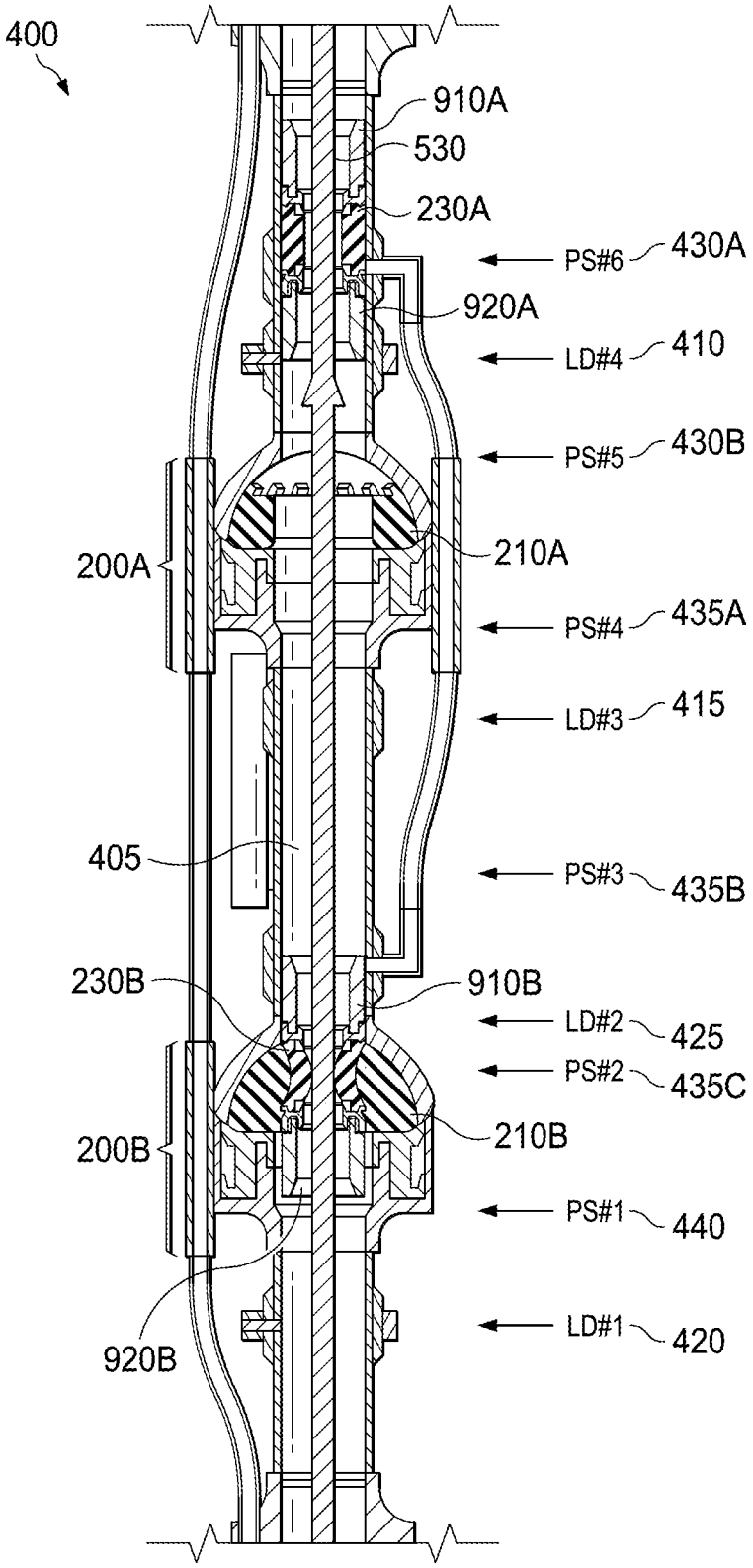
FIG. 9C shows a cross-sectional view of the upper sealing element being stripped out on the running tool while the lower sealing element seals the annulus surrounding the running tool in accordance with one or more embodiments of the present invention.
Figure 9D:
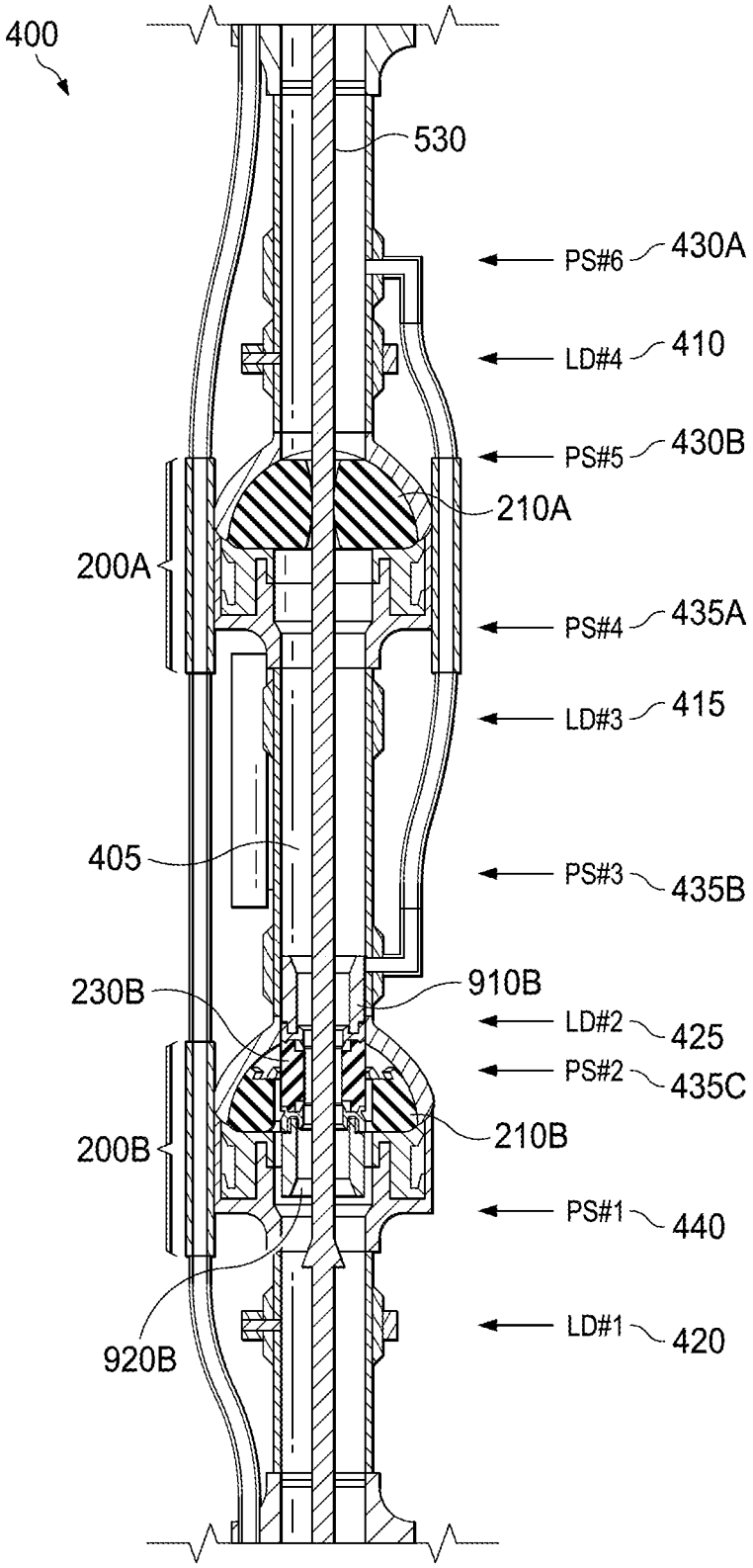
FIG. 9D shows a cross-sectional view of the running tool stripping in the annular sealing system with an upper packer of the annular sealing system sealing the annulus surrounding the running tool and a lower annular packer of the annular sealing system disengaged in accordance with one or more embodiments of the present invention.

Continuing, FIG. 9C shows a cross-sectional view of upper sealing element 230*a* being stripped out on running tool 530 while lower sealing element 230*b* seals the annulus surrounding running tool 530 in accordance with one or more embodiments of the present invention. Running tool 530 may be stripped out, for example, until proximity sensor 430*a* (not shown, reference numeral depicting general location only) detects true and proximity sensor 430*b* (not shown, reference numeral depicting general location only) detects false. A plurality of locking dogs 415 (not shown, reference numeral depicting general location only) may be unlocked. Upper sealing element 230*a* may be stripped out with running tool 530. Continuing, FIG. 9D shows a cross-sectional view of running tool 530 stripping in annular sealing system 400 with an upper annular packer 210*a* of annular sealing system 400 sealing the annulus surrounding running tool 530 and a lower annular packer 210*b* of annular sealing system 400 disengaged in accordance with one or more embodiments of the present invention. A plurality of locking dogs 425 (not shown, reference numeral depicting general location only) disposed above the top side of the lower annular packer system 200*b* may be unlocked. Running tool 530 may be stripped out until lower sealing element 230*b* is in an intermediate area 405 between upper annular packer system 200*a* and lower annular packer system 200*b*.

Figure 9E:
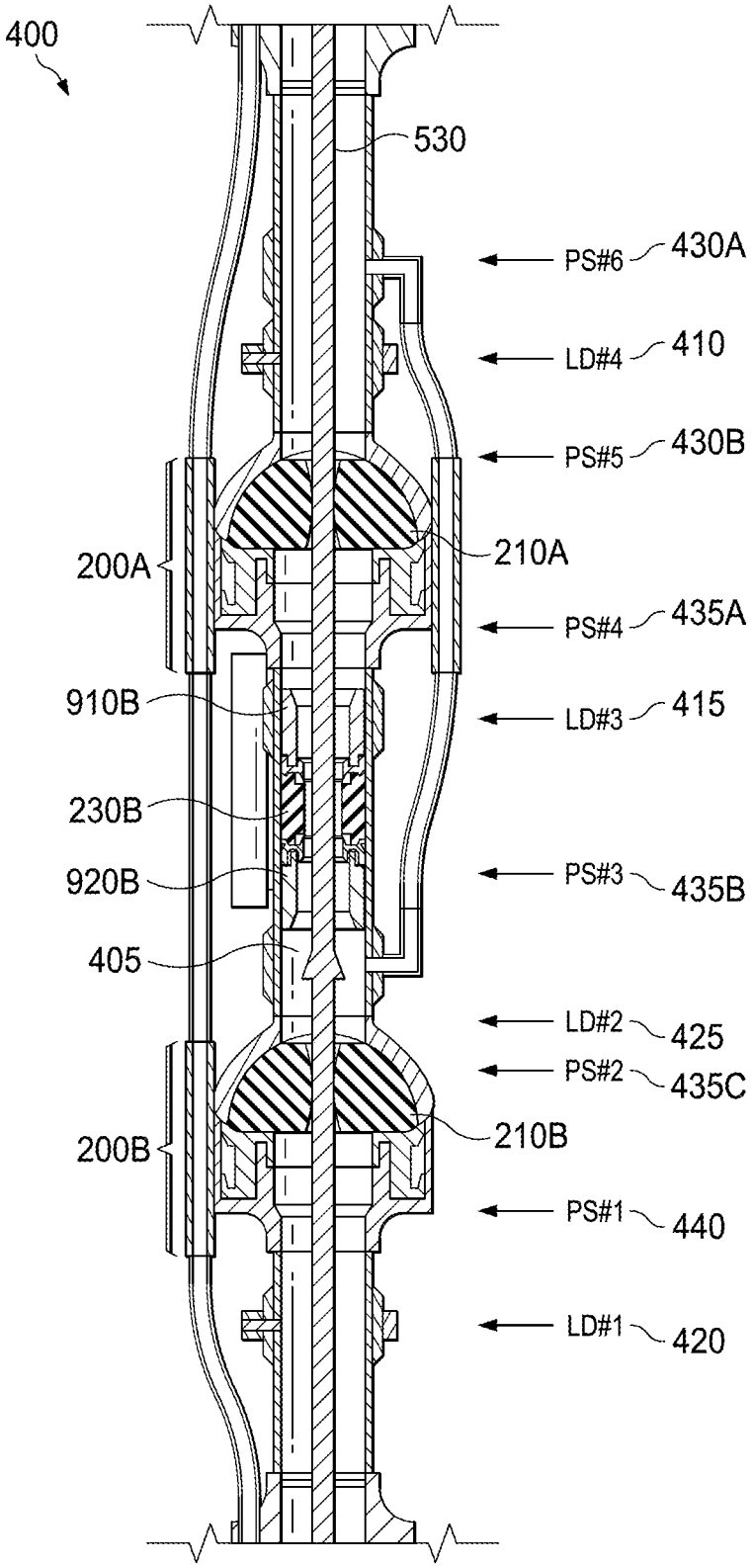
FIG. 9E shows a cross-sectional view of the lower sealing element moving into an intermediate area of the annular sealing system and the lower annular packer engaged to seal the annulus surrounding the running tool in accordance with one or more embodiments of the present invention.
Figure 9F:
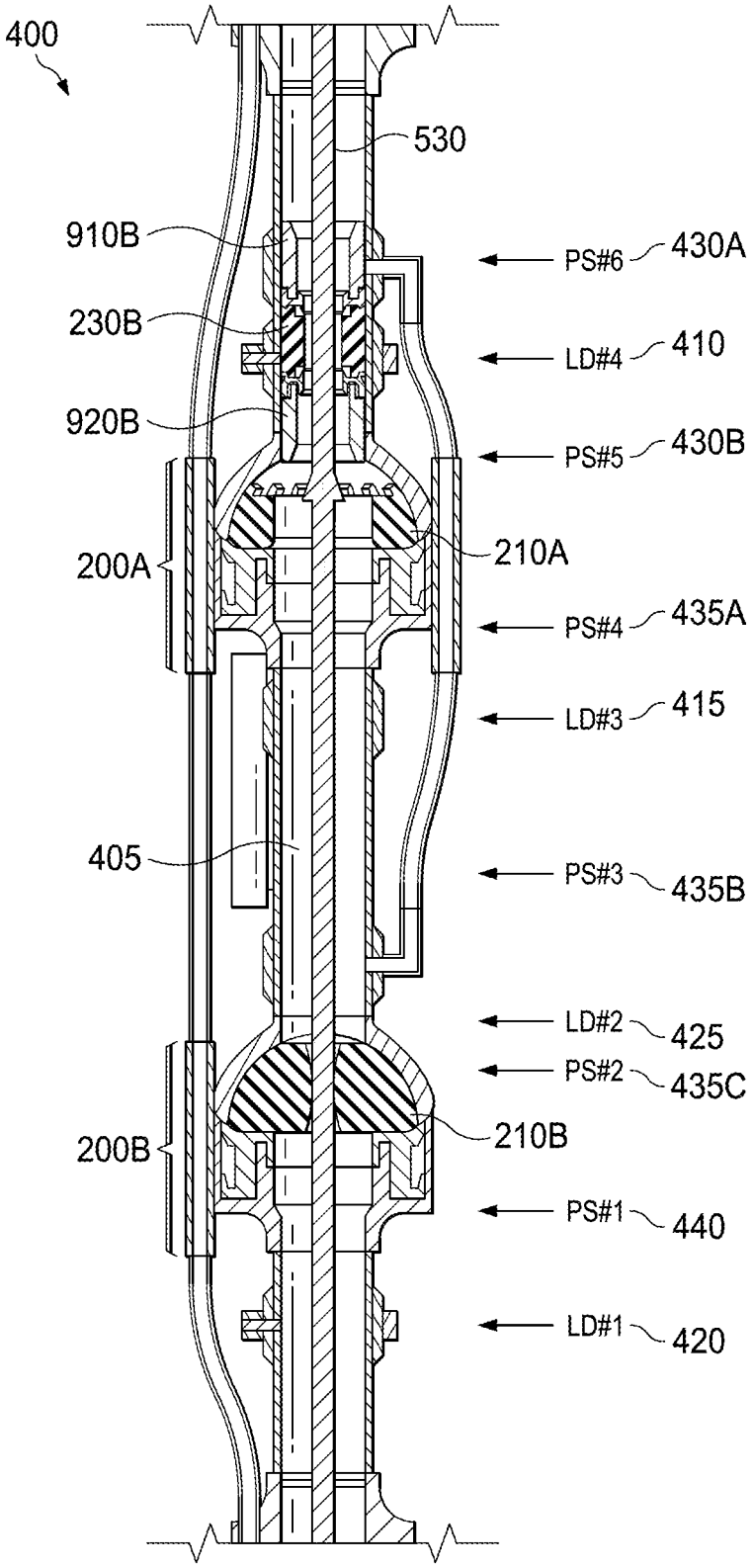
FIG. 9F shows a cross-sectional view of the lower sealing element being stripped out on the running tool while the lower annular packer seals the annulus surrounding the running tool in accordance with one or more embodiments of the present invention.

Continuing, FIG. 9E shows a cross-sectional view of lower sealing element 230*b* moving into an intermediate area 405 of annular sealing system 400 and lower annular packer 210*b* engaged to seal the annulus surrounding running tool 530 in accordance with one or more embodiments of the present invention. The plurality of locking dogs 425 (not shown, reference numeral depicting general location only) may be locked when, for example, proximity sensor 435*b* (not shown, reference numeral depicts general location only) detects true. Lower annular packer system 200*b* may be engaged to seal the annulus surrounding running tool 530 with lower annular packer 210*b*. Continuing, FIG. 9F shows a cross-sectional view of lower sealing element 230*b* being stripped out on running tool 530 while lower annular packer 210*b* seals the annulus surrounding running tool 530 in accordance with one or more embodiments of the present invention. The pressure of intermediate area 405 may be equalized with the pressure above upper annular packer system 200*a*. Upper annular packer system 200*a* may be disengaged to unseal the annulus surrounding running tool 530 with upper annular packer 210*a*. Running tool 530 may then be stripped out with lower sealing element 230*b*.

Figure 10A:
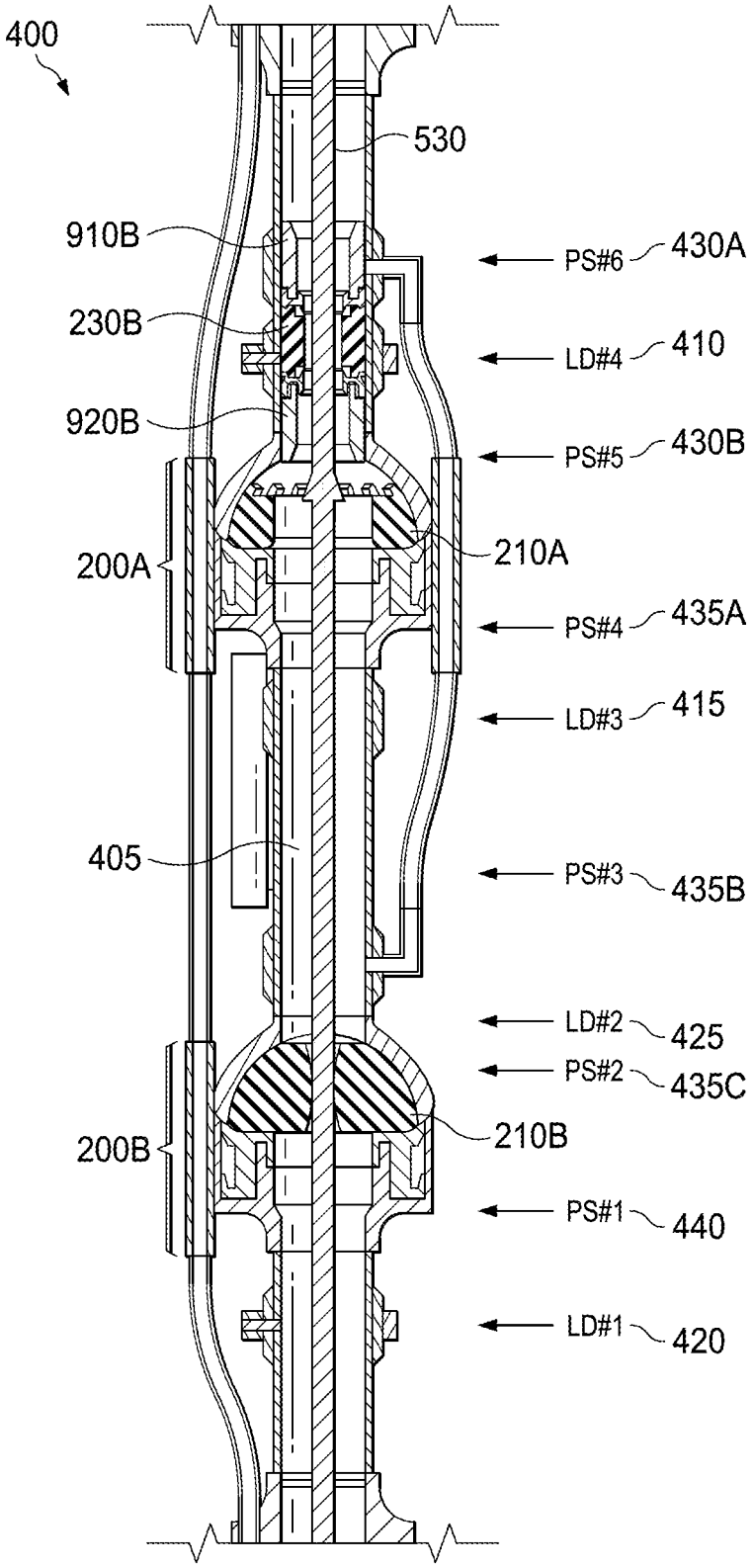
FIG. 10A shows a cross-sectional view of a running tool stripping in an ACD-type annular sealing system with a lower sealing element while an upper annular packer system is disengaged and a lower annular packer system seals the annulus surrounding the running tool with a lower annular packer in accordance with one or more embodiments of the present invention.
Figure 10B:
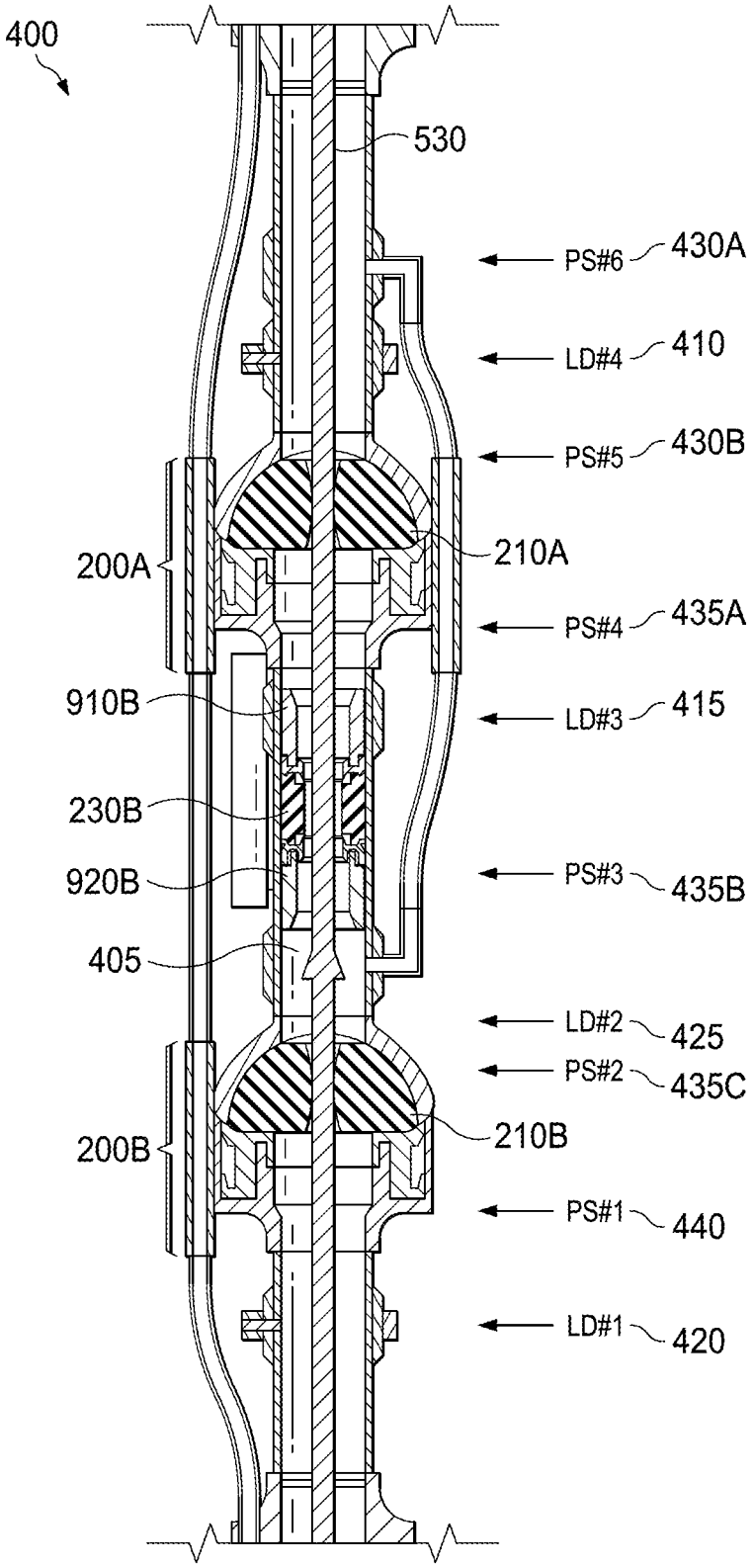
FIG. 10B shows a cross-sectional view of the running tool stripping in the annular sealing system with the lower sealing element positioned in between the upper annular packer system and the lower annular packer system while the upper annular packer and the lower annular packer seal the annulus surrounding the running tool in accordance with one or more embodiments of the present invention.

FIG. 10A shows a cross-sectional view of a running tool 530 stripping in an ACD-type annular sealing system 400 with a replacement lower sealing element 230*b* while an upper annular packer system 200*a* is disengaged and a lower annular packer system 200*b* seals the annulus surrounding running tool 530 with lower annular packer 210*b* in accordance with one or more embodiments of the present invention. Continuing, FIG. 10B shows a cross-sectional view of running tool 530 stripping in annular sealing system 400 with lower sealing element 230*b* positioned in between upper annular packer system 200*a* and lower annular packer system 200*b* while the upper annular packer 210*a* and lower annular packer 210*b* seal the annulus surrounding running tool 530 in accordance with one or more embodiments of the present invention. A plurality of locking dogs 425 (not shown, reference numeral depicting general location only) disposed above the top side of lower annular packer system 200*b* may be locked, if not already locked. Upper annular packer system 200*a* may be engaged to seal the annulus surrounding running tool 530 with upper annular packer 210*a*. A plurality of locking dogs 425 (not shown, reference numeral depicting general location only) may be unlocked. Lower annular packer system 200*b* may be disengaged to unseal the annulus surrounding running tool 530 with lower annular packer 210*b*. Running tool 530 may strip in to place lower sealing element 230*b* within lower annular packer system 200*b*. A plurality of locking dogs 425 (not shown, reference numeral depicting general location only) may be locked. Lower annular packer system 200*b* may be engaged to seal the annulus surrounding running tool 530 with lower sealing element 230*b*.

Figure 10C:
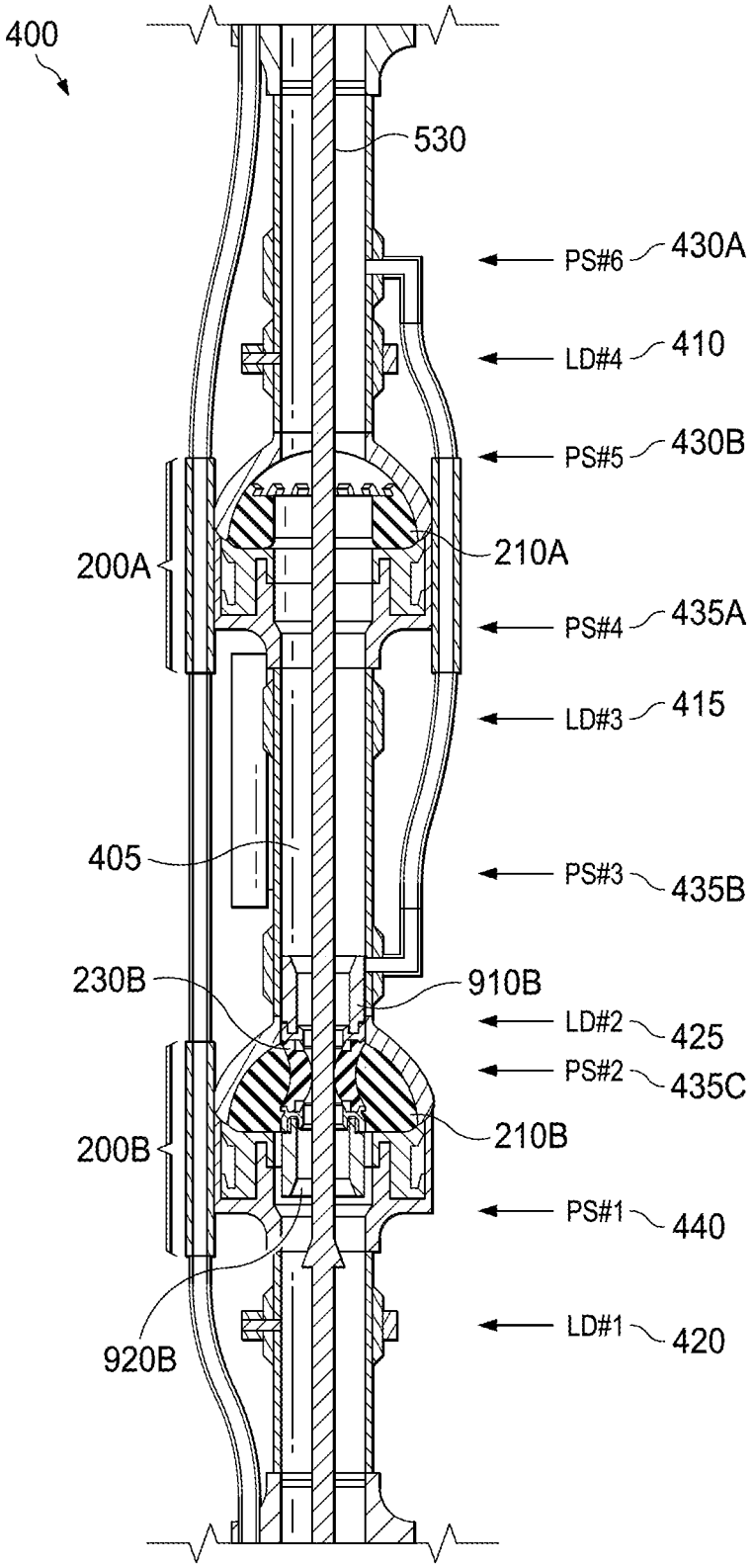
FIG. 10C shows a cross-sectional view of the running tool prior to stripping out of the annular sealing system while the lower sealing element seals the annulus surrounding the running tool and the upper annular packer system is disengaged in accordance with one or more embodiments of the present invention.
Figure 10D:
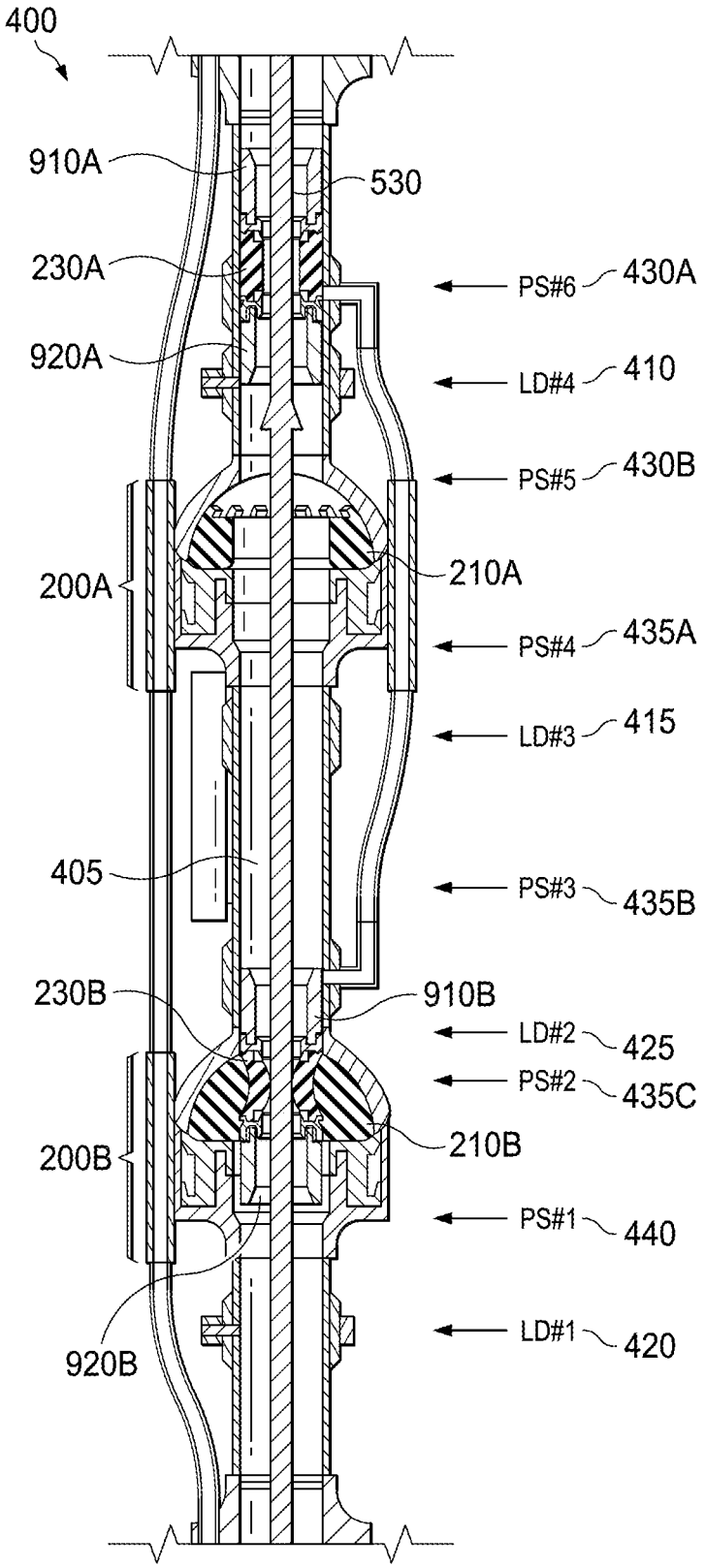
FIG. 10D shows a cross-sectional view of the running tool stripping in the annular sealing system with an upper sealing element 230*a* while the upper annular packer system is disengaged and the lower sealing element seals the annulus surrounding the running tool in accordance with one or more embodiments of the present invention.

Continuing, FIG. 10C shows a cross-sectional view of running tool 530 prior to stripping out of annular sealing system 400 while lower sealing element 230*b* seals the annulus surrounding running tool 530 and upper annular packer system 200*a* is disengaged in accordance with one or more embodiments of the present invention. A pressure of intermediate area 405 between upper annular packer system 200*a* and lower annular packer system 200*b* may be equalized with a pressure above upper annular packer system 200*a*. Upper annular packer system 200*a* may be disengaged unsealing the annulus surrounding running tool 530 with upper annular packer 210*a*. Running tool 530 may then be stripped out. Continuing, FIG. 10D shows a cross-sectional view of running tool 530 stripping in annular sealing system 400 with a replacement upper sealing element 230*a* while upper annular packer system 200*a* is disengaged and lower sealing element 230*b* seals the annulus surrounding running tool 530 in accordance with one or more embodiments of the present invention. A plurality of locking dogs 415 (not shown, reference numeral depicting general location only) disposed below the bottom side of upper annular packer system 200*a* may be locked. Running tool 530 may be stripped in to place upper sealing element 230*a* within upper annular packer system 200*a*. The plurality of locking dogs 410 (not shown, reference numeral depicting general location only) disposed above the top side of the upper annular packer system 200*a* may be locked.

Figure 10E:
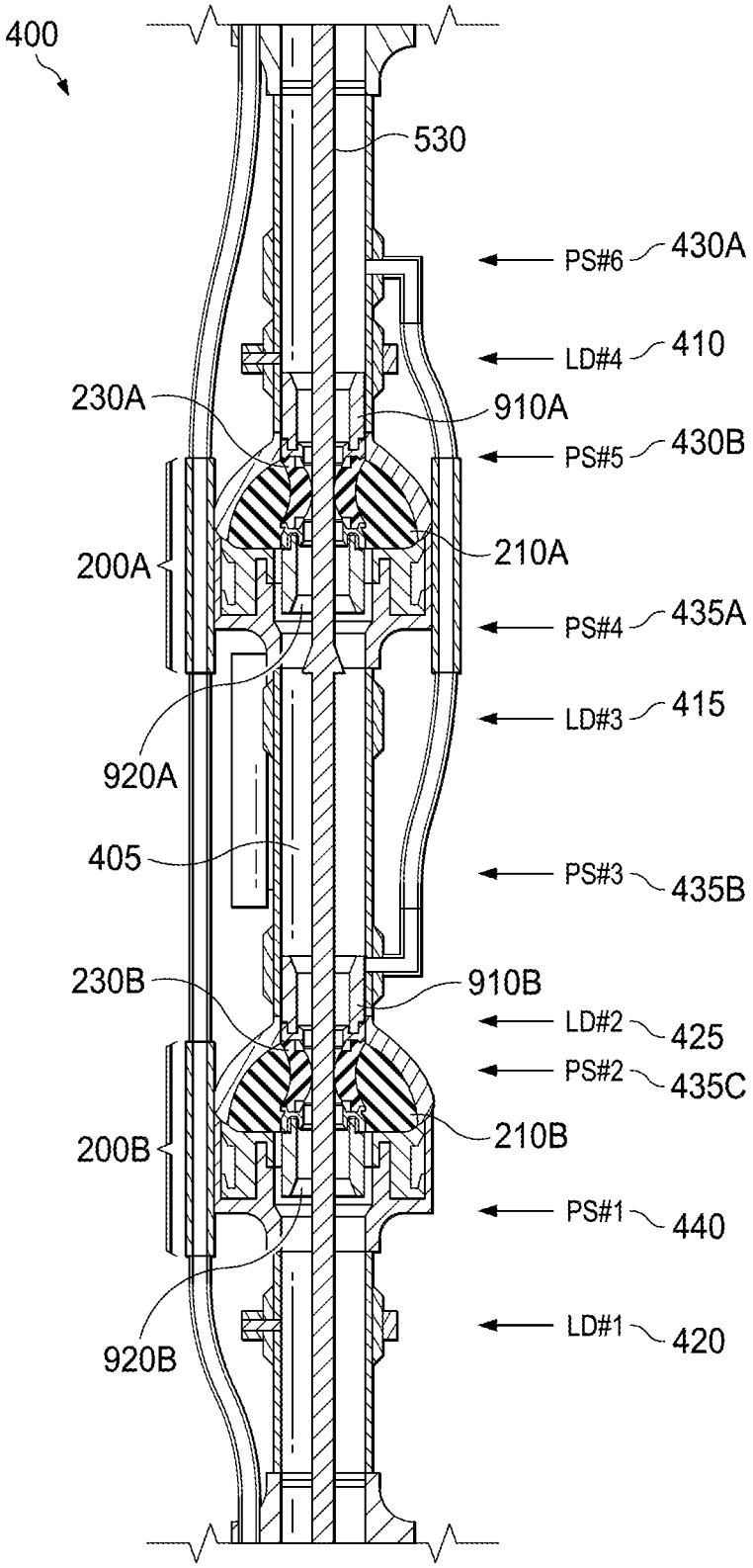
FIG. 10E shows a cross-sectional view of the running tool stripping out of the annular sealing system while the upper sealing element and the lower sealing element seal the annulus surrounding the running tool in accordance with one or more embodiments of the present invention.

Continuing, FIG. 10E shows a cross-sectional view of running tool 530 prior to stripping out of annular sealing system 400 while upper sealing element 230*a* and lower sealing element 230*b* seal the annulus surrounding running tool 530 in accordance with one or more embodiments of the present invention. Upper annular packer system 200*a* may be engaged to seal the annulus surrounding running tool 530 with upper sealing element 230*a*. Running tool 530 may be stripped out, seal lubrication may be initiated, and a stand of drill pipe (not shown) may then be stripped back in while maintaining the annular seal. Once complete, drilling activities may resume.

Figure 11A:
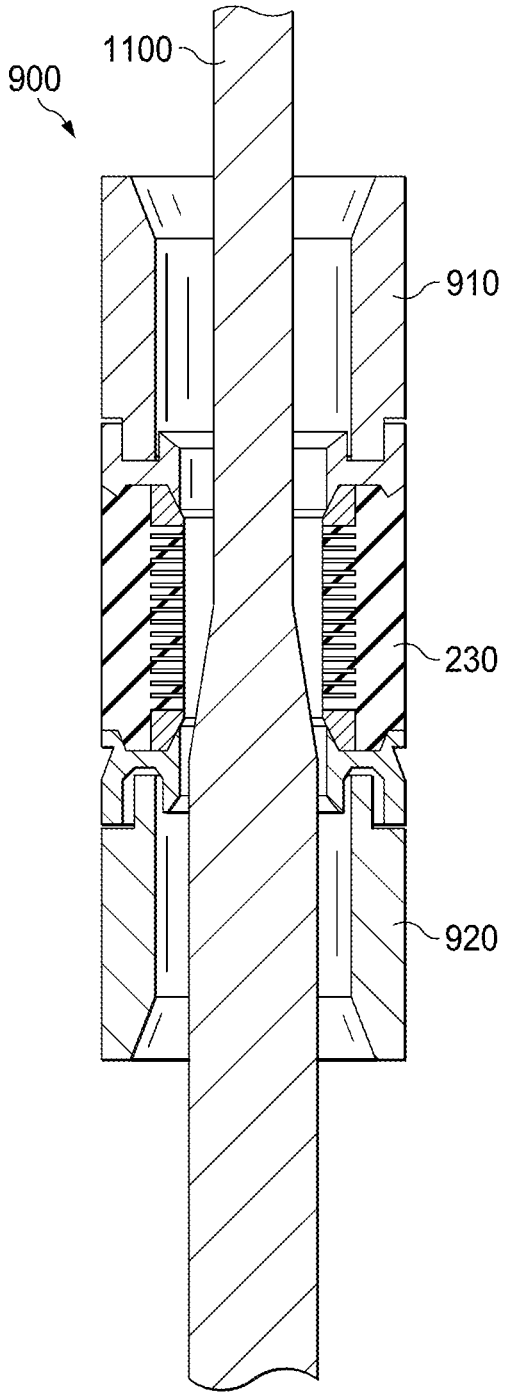
FIG. 11A shows a cross sectional view of a running tool with electrically actuated fins in a retracted state in accordance with one or more embodiments of the present invention.
Figure 11B:
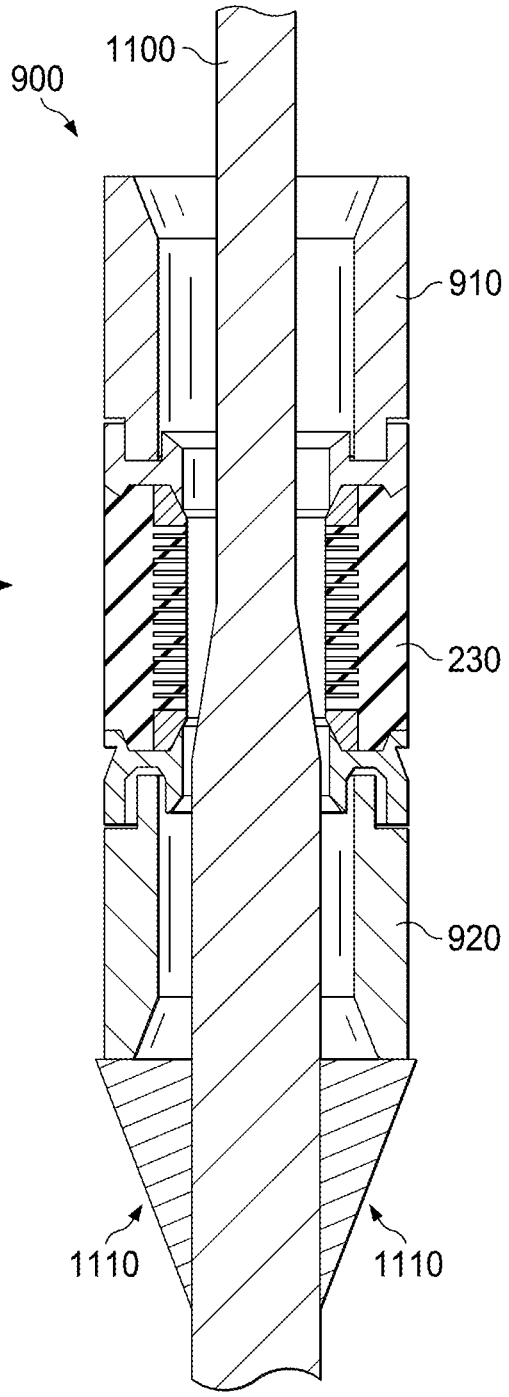
FIG. 11B shows a cross-sectional view of the running tool with electrically actuated fins in an extended state in accordance with one or more embodiments of the present invention.

FIG. 11A shows a cross sectional view of a running tool 1100 with electrically actuated fins (not shown) in a retracted state in accordance with one or more embodiments of the present invention. Continuing, FIG. 11B shows a cross-sectional view of running tool 1100 with electrically actuated fins 1110 actuated in an extended state in accordance with one or more embodiments of the present invention. In the extended state, fins 1110 may catch a distal end of, for example, spacer mandrel 920. One of ordinary skill in the art will recognize a shape, size, and number of electrically-actuated fins may vary based on an application or design in accordance with one or more embodiments of the present invention.

Figure 12:
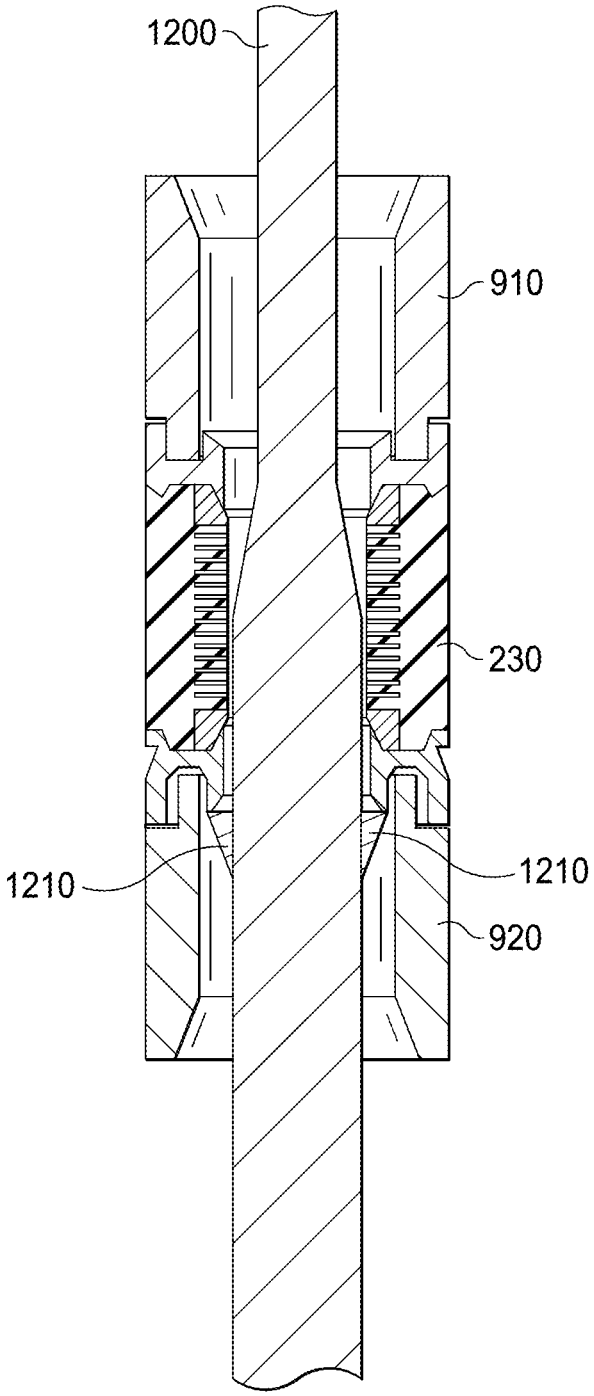
FIG. 12 shows a cross-sectional view of a running too with spring-loaded fins in accordance with one or more embodiments of the present invention.

FIG. 12 shows a cross-sectional view of a running tool 1200 with spring-loaded fins 1210 in accordance with one or more embodiments of the present invention. Running tool 1200 may be disposed through sealing element 230 until a spring-loaded portion clears the bottom of sealing element 230 and fins 1210 deploy allowing sealing element 230 to be retrieved independent of mandrel 920. One of ordinary skill in the art will recognize a shape, size, and number of spring-loaded fins may vary based on an application or design in accordance with one or more embodiments of the present invention.

Advantages of one or more embodiments of the present invention may include, but is not limited to, one or more of the following:

In one or more embodiments of the present invention, an annular sealing system allows for the installation, engagement, service, maintenance, disengagement, removal, or replacement of one or more sealing elements while maintaining a pressure tight seal on the annulus. Advantageously, one or more sealing elements may be changed out during hole sections and in between bit runs. During bit runs, the SSBOP is typically closed allowing the marine riser to be depressurized, such that the annular sealing system may be disengaged, and the sealing elements freely replaced. Notwithstanding, the annular sealing system is capable of maintaining the pressure tight seal on the annulus during bit runs as well, if so desired.

In one or more embodiments of the present invention, an integrated MPD riser joint may be limited to the annular sealing system and a flow spool, or equivalent thereof, disposed directly below the annular sealing system. Advantageously, the integrated MPD riser joint may be substantially shorter in length and weigh substantially less than a conventional integrated MPD riser joint. The reduction in size and weight enables adoption of MPD technology in applications where conventional integrated MPD riser joints are not economically feasible or are otherwise precluded from use for technical reasons.

In one or more embodiments of the present invention, an annular sealing system includes a discrete and independently controllable upper sealing element and a discrete and independently controllable lower sealing element. One of the sealing elements may be installed, engaged, serviced, disengaged, or removed while the other sealing element maintains the pressure tight seal on the annulus.

In one or more embodiments of the present invention, an annular sealing system includes an upper sealing element and a lower sealing element that are attached to a spring-biased mandrel, where the upper sealing element and the lower sealing element are independently controllable. One of the sealing elements may be installed, engaged, serviced, disengaged, or removed while the other sealing element, or one or more annular packers, maintains the pressure tight seal on the annulus.

In one or more embodiments of the present invention, an annular sealing system includes an upper sealing element and a lower sealing element that are attached to a spacer mandrel, where the upper sealing element and the lower sealing element are independently controllable. One of the sealing elements may be installed, engaged, serviced, disengaged, or removed while the other sealing element, or one or more annular packers, maintains the pressure tight seal on the annulus.

In one or more embodiments of the present invention, an annular sealing system may be an active control device that includes an upper annular packer system and a lower annular packer system that may independently engage or disengage the upper sealing element and the lower sealing element (and drill pipe disposed therethrough) or the running tool.

In one or more embodiments of the present invention, an annular sealing system may be a rotating control device where the upper sealing element is disposed within an upper seal and bearing assembly and the lower sealing element is disposed within a lower seal and bearing assembly.

In one or more embodiments of the present invention, an annular sealing system may be substituted for a conventional annular sealing system and drill string isolation tool, or equivalent thereof, as part of an integrated MPD riser joint.

In one or more embodiments of the present invention, an annular sealing system, that does not require the use of a drill string isolation tool, or equivalent thereof, is substantially the same size and weight as a conventional annular sealing system that requires the use of a drill string isolation tool, or equivalent thereof.

In one or more embodiments of the present invention, the costs associated with delivering, installing, operating, and removal an integrated MPD riser joint with an annular system are substantially reduced.

In one or more embodiments of the present invention, an integrated MPD riser joint with an annular sealing system is substantially smaller in size and weighs substantially less than a conventional integrated MPD riser joint due to the removal of the drill string isolation tool, or equivalent thereof. As such, the desk space and weight-carrying capacity required to deliver the integrated MPD riser joint, and associated costs, is substantially less than that of a conventional integrated MPD riser joint. In addition, installation and removal of the integrated MPD riser joint is substantially easier and safer than that of a conventional integrated MPD riser joint.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An integrated MPD riser joint for maintaining a pressure tight seal on an annulus surrounding drill pipe comprising:

an annular sealing system comprising:

a controllable upper sealing element, and a controllable lower sealing element, wherein the upper sealing element and lower sealing element receive drill pipe through an inner diameter, and wherein an annulus surrounding the drill pipe is controllably sealed with one or more of the upper sealing element and the lower sealing element; and a flow spool disposed directly below the annular sealing system that diverts returning fluids to the surface, wherein the upper sealing element and the lower sealing element are attached to a spacer mandrel and are independently controllable, and wherein the annular sealing system maintains a pressure tight seal on the annulus while installing, servicing, or removing one or more of the sealing elements of the annular sealing system.

2. The integrated MPD riser joint of claim 1, wherein the annular sealing system maintains the pressure tight seal on the annulus while one or more sealing elements are installed, engaged, serviced, maintained, disengaged, or removed without any other pressure containment device or system.

3. The integrated MPD riser joint of claim 1, wherein the upper sealing element is installed, engaged, serviced, disengaged, or removed while the lower sealing element or an annular packer system of the annular sealing system maintains the pressure tight seal on the annulus.

4. The integrated MPD riser joint of claim 1, wherein the lower sealing element is installed, engaged, serviced, disengaged, or removed while the upper sealing element or an annular packer system of the annular sealing system maintains the pressure tight seal on the annulus.

5. The integrated MPD riser joint of claim 1, wherein the upper sealing element and the lower sealing element are discrete components that are independently moveable and controllable.

6. The integrated MPD riser joint of claim 1, wherein the upper sealing element and the lower sealing element are attached to a spring-biased mandrel and are independently controllable.

7. The integrated MPD riser joint of claim 1, wherein the annular sealing system comprises an upper packer system that engages or disengages the upper sealing element or a running tool and a lower packer system that engages or disengages the lower sealing element or the running tool.

8. The integrated MPD riser joint of claim 1, wherein the upper sealing element is disposed within an upper seal and bearing assembly and the lower sealing element is disposed within a lower seal and bearing assembly.

9. A method of maintaining a pressure tight seal on an annulus while removing or installing a plurality of sealing elements of an annular sealing system comprising:

disposing a controllable upper sealing element on a first spacer mandrel and a controllable lower sealing element on a second spacer mandrel within an annular sealing system, wherein the upper sealing element is positioned for engagement by an upper packer system and the lower sealing element is positioned for engagement by a lower packer system of the annular sealing system;

disposing drill pipe through an inner diameter of the annular sealing system;

engaging the annular sealing system during drilling operations;

stripping out a stand of drill pipe disposed within the upper sealing element and the lower sealing element of the annular sealing system;

stripping in with a running tool through the upper sealing element and the lower sealing element;

engaging the upper packer system to seal the annulus with the upper sealing element;

disengaging a lower packer system to unseal the annulus with the lower sealing element;

unlocking a plurality of locking dogs disposed above a top side of the lower packer system;

pulling the lower sealing element into an intermediate area within the annular sealing system between a plurality of locking dogs disposed below a bottom side of the upper annular packer system and a plurality of locking dogs disposed above a top side of the lower annular packer system;

locking the plurality of locking dogs disposed above the top side of the lower annular packer system;

engaging the lower annular packer system to seal the annulus with the lower annular packer;

disengaging an upper annular packer system to unseal the annulus with the upper sealing element;

unlocking a plurality of locking dogs disposed above a top side of the upper annular packer system;

stripping out the running tool until the upper sealing element clears the upper annular packer system;

unlocking a plurality of locking dogs disposed below the bottom side of the upper annular packer system; and stripping out the running tool with the upper sealing element and the lower sealing element.

10. The method of claim 9, further comprising:

stripping in with the running tool with a replacement upper sealing element and a replacement lower sealing element;

setting the replacement upper sealing element in place relative to the upper annular packer system;

locking the plurality of locking dogs disposed below the bottom side of the upper annular packer system;

locking the plurality of locking dogs disposed above the top side of the upper annular packer system;

engaging the upper annular packer system to seal the annulus surrounding the running tool with the upper sealing element;

equalizing the intermediate area with wellbore pressure;

disengaging the lower annular packer system to unseal the annulus surrounding the running tool;

setting the replacement lower sealing element in place relative to the lower annular packer system;

locking the plurality of locking dogs disposed above the top side of the lower annular packer system;

engaging the lower annular packer system to seal the annulus surrounding the running tool with the lower sealing element;

stripping out the running tool; and stripping in with the stand of drill pipe.

* * * * *